US009471035B2

(12) United States Patent
Sato

(10) Patent No.: US 9,471,035 B2
(45) Date of Patent: Oct. 18, 2016

(54) HANDLE OF DRUM CARTRIDGE AND IMAGE FORMING APPARATUS INCLUDING THE SAME

(71) Applicant: BROTHER KOGYO KABUSHIKI KAISHA, Nagoya-shi, Aichi-ken (JP)

(72) Inventor: Shougo Sato, Seto (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/817,971

(22) Filed: Aug. 4, 2015

(65) Prior Publication Data

US 2016/0041519 A1 Feb. 11, 2016

(30) Foreign Application Priority Data

Aug. 8, 2014 (JP) ..... 2014-163002

(51) Int. Cl.
*G03G 21/00* (2006.01)
*G03G 21/18* (2006.01)
*G03G 21/16* (2006.01)

(52) U.S. Cl.
CPC ..... *G03G 21/1846* (2013.01); *G03G 21/1633* (2013.01); *G03G 21/1817* (2013.01); *G03G 21/1821* (2013.01); *G03G 2221/1846* (2013.01); *G03G 2221/1869* (2013.01)

(58) Field of Classification Search
CPC ..... G03G 21/1633; G03G 21/1676; G03G 21/1821; G03G 21/1846; G03G 2221/1853; G03G 2221/1869
USPC ..... 399/111, 113
See application file for complete search history.

(56) References Cited

U.S. PATENT DOCUMENTS 7,844,197 B2 * 11/2010 Ishii ..... G03G 21/1857 399/113
8,116,660 B2 * 2/2012 Watanabe ..... G03G 21/1853 399/111
2006/0245786 A1 * 11/2006 Suzuki ..... G03G 21/1821 399/111
2008/0240774 A1 * 10/2008 Fukamachi ..... G03G 15/0855 399/111
2011/0274462 A1 * 11/2011 Kim ..... G03G 21/1846 399/119
2013/0164030 A1 * 6/2013 Anan ..... G03G 21/1821 399/111
2015/0023692 A1 * 1/2015 Tanaka ..... G03G 21/1846 399/113
2015/0205256 A1 * 7/2015 Matsumaru ..... G03G 21/1814 399/111

FOREIGN PATENT DOCUMENTS

JP 2003-202792 A 7/2003
JP 2005-148702 A 6/2005
JP 2007-219267 A 8/2007
JP 2010079205 A * 4/2010

* cited by examiner

*Primary Examiner* — Robert Beatty
(74) *Attorney, Agent, or Firm* — Merchant & Gould P.C.

(57) ABSTRACT

An image forming apparatus includes a printer body, a drum cartridge detachably attachable to the printer body, and a developing cartridge detachably attachable to the drum cartridge. The drum cartridge includes a handle and an urging member. The handle is configured to move between a protruding position at which the handle protrudes toward an attaching/detaching path for attaching and detaching the developing cartridge to and from the drum cartridge and a retracted position at which the handle is located farther from the attaching/detaching path than the handle that is located at the protruding position. The urging member urges the handle toward the protruding position. The handle is configured to protrude toward the protruding position by an urging force of the urging member when the developing cartridge is detached from the drum cartridge.

20 Claims, 10 Drawing Sheets

1

UP
FRONT
REAR
DOWN

UP
FRONT
REAR
DOWN

HANDLE OF DRUM CARTRIDGE AND IMAGE FORMING APPARATUS INCLUDING THE SAME

CROSS-REFERENCE TO RELATED APPLICATION

This application claims priority from Japanese Patent Application No. 2014-163002, filed on Aug. 8, 2014, which is incorporated herein by reference in their entirety.

TECHNICAL FIELD

Aspects described herein relate to an electrophotographic image forming apparatus.

BACKGROUND

A known image forming apparatus includes an apparatus body, a drum cartridge including a photosensitive drum, and a developing cartridge storing toner therein.

In the image forming apparatus, both of the developing cartridge and the drum cartridge are detachably attached to the apparatus body, and the developing cartridge is placed further to the front than the drum cartridge.

In such an image forming apparatus, the developing cartridge is detached from the apparatus body first, and then the drum cartridge is detached from the apparatus body.

SUMMARY

In the image forming apparatus, the developing cartridge may be placed further to the front than the drum cartridge. Therefore, a user may readily access the developing cartridge, and such an arrangement may ensure a smooth attachment and detachment of the developing cartridge to and from the apparatus body.

The drum cartridge may be placed further to the rear than the developing cartridge in the apparatus body. Therefore, the drum cartridge may be located relatively far from the user. Accordingly, such an arrangement may complicate detachment of the drum cartridge from the apparatus body.

According to one or more aspects of the disclosure, an image forming apparatus may include a printer body, a drum cartridge, and a developing cartridge. The drum cartridge may be detachably attachable to the printer body and may include a photosensitive drum. The developing cartridge may be detachably attachable to the drum cartridge and may be configured to store a developing agent therein. The developing cartridge may be located downstream of the photosensitive drum in a detaching direction in which the developing cartridge may be detached from the drum cartridge when the developing cartridge may be attached to the drum cartridge. The drum cartridge may include a handle and an urging member. The handle may be configured to move between a protruding position at which the handle may protrude toward an attaching/detaching path for attaching and detaching the developing cartridge to and from the drum cartridge and a retracted position at which the handle may be located farther from the attaching/detaching path than the handle that may be located at the protruding position. The urging member may urge the handle toward the protruding position. The handle may be configured to protrude toward the protruding position by an urging force of the urging member when the developing cartridge may be detached from the drum cartridge.

According to one or more other aspects of the disclosure, an image forming apparatus may include a printer body, a drum cartridge, a developing cartridge, a first pressing mechanism, and a second pressing mechanism. The drum cartridge may be detachably attachable to the printer body and may include a photosensitive drum. The developing cartridge may be detachably attachable to the drum cartridge and may be configured to store a developing agent therein. The first pressing mechanism may be configured to press the developing cartridge downwardly. The second pressing mechanism may be configured to press the developing cartridge upwardly. In response to release of pressing of the first pressing mechanism, the second pressing mechanism may be configured to press the developing cartridge upwardly with respect to the drum cartridge.

According to one or more other aspects of the disclosure, an image forming apparatus may include a printer body, a drum cartridge, a developing cartridge, and a pressing mechanism. The drum cartridge may be detachably attachable to the printer body and may include a photosensitive drum. The developing cartridge may be detachably attachable to the drum cartridge in a predetermined direction and may be configured to store a developing agent therein. The pressing mechanism may be configured to press the developing cartridge upwardly. In response to detaching the developing cartridge from the drum cartridge, the pressing mechanism may be configured to protrude in the predetermined direction.

DESCRIPTION OF THE DRAWINGS

Aspects of the disclosure are illustrated by way of example and not by limitation in the accompanying figures in which like reference characters indicate similar elements.

DETAILED DESCRIPTION

Figure 1:
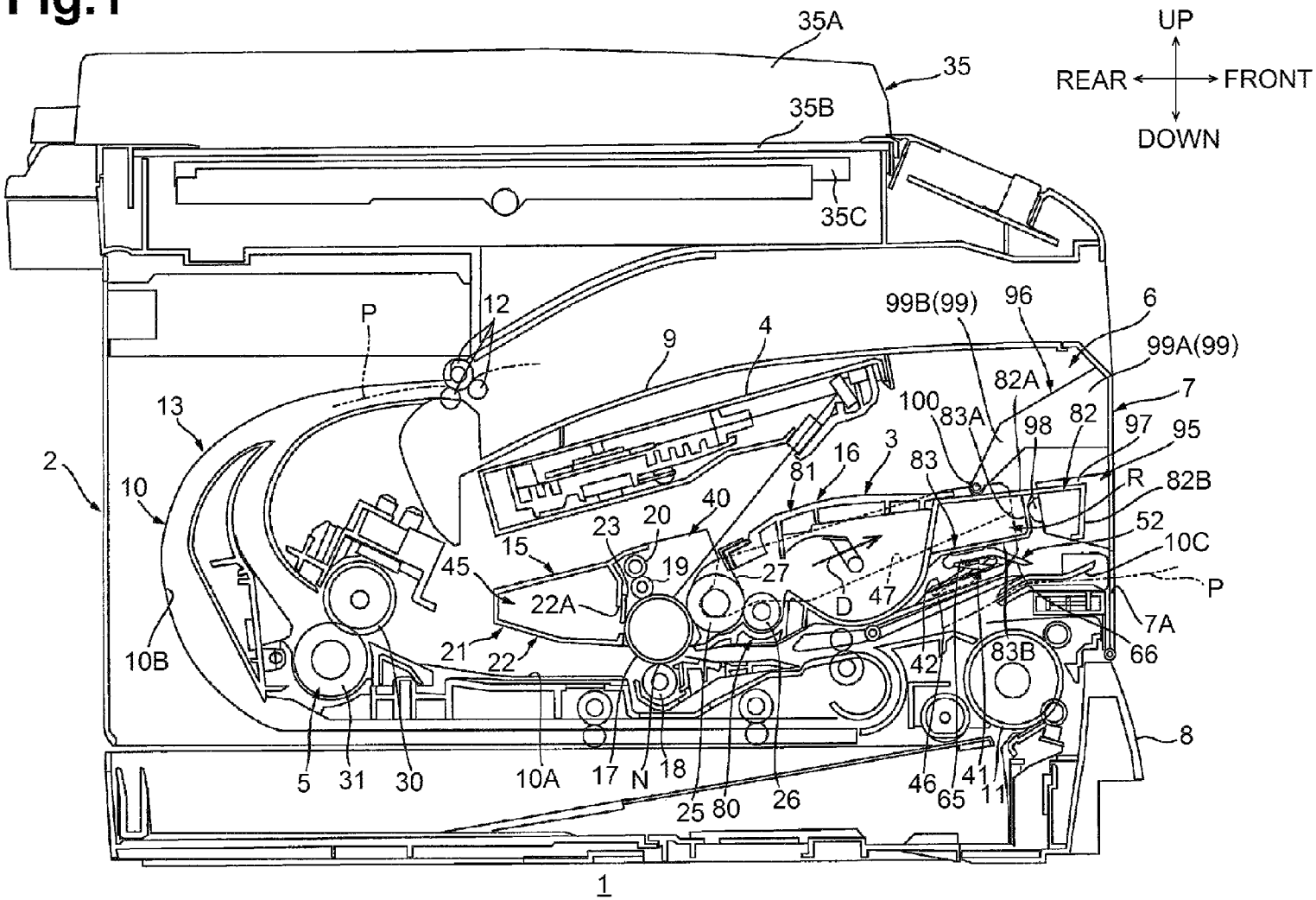
FIG. 1 is a central cross-sectional view depicting a printer as an image forming apparatus in a first illustrative embodiment according to one or more aspects of the disclosure, wherein a front cover is located at a closing position.

Hereinafter, first to sixth illustrative embodiments in which the disclosure is implemented will be described with reference to the accompanying drawings.

1. Overview of Printer

A printer 1 (as an example of an image forming apparatus) may be an electrophotographic monochrome printer. The printer 1 includes a printer body 2, a process unit 3, a scanner unit 4, a fixing unit 5, a sheet conveyor unit 13, and a flatbed scanner 35.

The printer body 2 has a substantially box shape. The printer body 2 has an opening 6 defined therein and further includes a front cover 7 (as an example of an opening/closing member), a feed tray 8, and a discharge tray 9.

The opening 6 is defined in one end of the printer body 2. The opening 6 provides communication between the outside and the inside of the printer body 2 and allows a drum cartridge 15 to pass therethrough.

The front cover 7 is disposed at the one end of the printer body 2. The front cover 7 has a substantially plate-like shape extending in an up-down direction. The front cover 7 is supported by the one end of the printer body 2 so as to be pivotable on a lower end of the front cover 7. The front cover 7 is pivotable between a closing position at which the front cover 7 closes the opening 6 (e.g., a position of the front cover depicted in FIG. 1) and an exposing position at which the front cover 7 exposes the opening 6 (e.g., a position of the front cover depicted in FIG. 2).

In the explanation below, a side of the printer 1, on which the front cover 7 is disposed, may be defined as the front of the printer 1, and the opposite side of the printer 1 may be defined as the rear of the printer 1. The right and left may be defined with reference to the front of the printer 1. More specifically, in each drawing, directions indicated by respective arrows may be applicable to the drawing. An orientation (e.g., up, down, right, left, front, and rear) of each of the drum cartridge 15 and a developing cartridge 16 may be defined with reference to the drum cartridge 15 and the developing cartridge that may be disposed in an orientation in which they may be intended to be attached to the printer body 2. The right-left direction is an example of an axial direction. The right is an example of one direction of the axial direction. The left is an example of the other direction of the axial direction.

The front cover 7 has a sheet entry port 7A. The sheet entry port 7A is defined in a lower portion of the front cover 7. The sheet entry port 7A has a shape and size that enables a sheet P to pass therethrough. The sheet entry port 7A penetrates the front cover 7 in the front-rear direction.

The feed tray 8 is disposed in the bottom of the printer body 2. The feed tray 8 has a substantially box shape with its upper end opened. The feed tray 8 is configured to accommodate one or more sheets P therein.

The discharge tray 9 is defined at an upper surface of the printer body 2. The discharge tray 9 is located at a substantially middle portion of the upper surface of the printer body 2 in the front-rear direction. The discharge tray 9 is recessed downward relative to the upper surface of the printer body 2 for supporting one or more sheets P thereon.

The process unit 3 is positioned in a substantially middle portion of the printer body 2 in the up-down direction while being located above the feed tray 8 and below the discharge tray 9.

The process unit 3 includes a drum cartridge 15, a developing cartridge 16, and a transfer roller 18.

The drum cartridge 15 is attachable to and detachable from the printer body 2 through the opening 6. The drum cartridge 15 includes a photosensitive drum 17, a charging roller 19, a cleaning roller 20, and a cleaning unit 21.

The photosensitive drum 17 has a substantially circular cylindrical shape extending in the right-left direction. The photosensitive drum 17 is disposed at a rearward portion of the drum cartridge 15 while being rotatably supported by the drum cartridge 15. The charging roller 19 charges a surface of the photosensitive drum 17. The charging roller 19 has a substantially circular column shape extending in the right-left direction. The charging roller 19 is disposed diagonally above to the rear relative to the photosensitive drum 17. More specifically, an axis of the charging roller 19 is disposed higher than and further to the rear of an axis of the photosensitive drum 17. A lower front end portion of the charging roller 19 is in contact with an upper rear end portion of the photosensitive drum 17.

The cleaning roller 20 eliminates extraneous matter, e.g., residual toner and paper dust, from a surface of the charging roller 19. The cleaning roller 20 has a substantially circular column shape extending in the right-left direction. The cleaning roller 20 is disposed diagonally above to the rear relative to the charging roller 19. More specifically, an axis of the cleaning roller 20 is disposed higher than and further to the rear of the axis of the charging roller 19. A lower front end portion of the cleaning roller 20 is in contact with an upper rear end portion of the charging roller 19.

The cleaning unit 21 eliminates extraneous matter, e.g., residual toner and paper dust, from the surface of the photosensitive drum 17. The cleaning unit 21 is disposed behind the photosensitive drum 17. The cleaning unit 21 includes a residual toner storage 22 and a scraper blade 23.

The residual toner storage 22 has a hollow cylindrical shape extending in the right-left direction. Right and left ends of the residual toner storage 22 are closed by rear end portions of right and left sidewalls 45, respectively.

The residual toner storage 22 has an opening 22A. The opening 22A is defined in a front wall of the residual toner storage 22 and penetrates the front wall of the residual toner storage 22 in the front-rear direction.

The scraper blade 23 is fixed to a portion of the front wall of the residual toner storage 22, e.g., an upper circumferential edge portion defining the opening 22A. The scraper blade 23 has a substantially plate-like shape extending in the up-down direction. A lower end portion of the scraper blade 23 is in contact with a rear end portion of the photosensitive drum 17.

The developing cartridge 16 is attachable to and detachable from the drum cartridge 15 that is to be attached the printer body 2. In a state where the developing cartridge 16 is joined to the drum cartridge 15, the developing cartridge 16 is located diagonally above to the front of the photosensitive drum 17. That is, the developing cartridge 16 is positioned downstream of the photosensitive drum 17 in a detaching direction D in the state where the developing cartridge 16 is joined to the drum cartridge 15.

The developing cartridge 16 includes a developing roller 25, a supply roller 26, and a layer-thickness regulating blade 27. The developing cartridge 16 stores toner (as an example of a developing agent) therein.

The developing roller 25 is disposed at a rear end portion of the developing cartridge 16. The developing roller 25 has a substantially circular column shape extending in the right-left direction. The developing roller 25 is rotatably supported by the developing cartridge 16. A lower rear end portion of the developing roller 25 is in contact with an upper front end portion of the photosensitive drum 17.

The supply roller 26 is disposed diagonally below to the front of the developing roller 25. More specifically, an axis of the supply roller 26 is located lower than and further to the front than an axis of the developing roller 25. The supply roller 26 has a substantially circular column shape extending in the right-left direction. The supply roller 26 is rotatably supported by the developing cartridge 16. An upper rear end portion of the supply roller 26 is in contact with a lower front end portion of the developing roller 25.

The layer-thickness regulating blade 27 is disposed diagonally above to the front of the developing roller 25. The layer-thickness regulating blade 27 is in contact with a front end portion of the developing roller 25.

The transfer roller 18 has a substantially circular column shape extending in the right-left direction. The transfer roller 18 is disposed below the photosensitive drum 17. An upper end portion of the transfer roller 18 is in contact with a lower end portion of the photosensitive drum 17.

The scanner unit 4 is disposed above the process unit 3 within the printer body 2. The scanner unit 4 emits a laser beam toward the photosensitive drum 17 based on image data.

The fixing unit 5 is disposed behind the process unit 3 within the printer body 2. The fixing unit 5 includes a heat roller 30 and a pressing roller 31. The pressing roller 31 is disposed diagonally below to the rear of the heat roller 30. An upper front end portion of the pressing roller 31 is in pressure contact with a lower rear end portion of the heat roller 30.

The sheet conveyor unit 13 conveys a sheet P within the printer body 2. The sheet conveyor unit 13 includes a conveyance guide 10, a feed roller 11, and a plurality of discharge rollers 12.

The conveyance guide 10 guides conveyance of a sheet P within the printer body 2. The conveyance guide 10 includes a first conveyance guide 10A, a second conveyance guide 10B, and a third conveyance guide 10C.

The first conveyance guide 10A guides conveyance of a sheet P such that the sheet P comes to reach the discharge tray 9 after the sheet P fed from the feed tray 8 passes a contact point N where the photosensitive drum 17 and the transfer roller 18 contact with each other. The first conveyance guide 10A defines a conveying path having an S shape in side view. An upstream end of the first conveyance guide 10A in the conveying direction is located diagonally above to the front of the feed tray 8 and is in communication with the feed tray 8. A downstream end of the first conveyance guide 10A in the conveying direction is contiguous with a rear wall of the discharge tray 9 and is in communication with the discharge tray 9.

The second conveyance guide 10B guides conveyance of a sheet P having an image on one side thereof such that the sheet P is supplied again to the contact point N of the photosensitive drum 17 and the transfer roller 18. An upstream end of the second conveyance guide 10B in the conveying direction is contiguous with and in communication with a downstream end portion of the first conveyance guide 10A in the conveying direction. A downstream end of the second conveyance guide 10B in the conveying direction is contiguous with and in communication with a particular portion of the first conveyance guide 10A. The particular portion of the first conveyance guide 10A is further to the front than the photosensitive drum 17.

The third conveyance guide 10C guides conveyance of a sheet P that is inserted into the printer body 2 from the outside of the printer body 2 through the sheet entry port 7A of the front cover 7 such that the sheet P comes to reach the first conveyance guide 10A. The third conveyance guide 10C is disposed higher than an upstream end portion of the first conveyance guide 10A in the conveying direction and behind the sheet entry port 7A. A downstream end of the third conveyance guide 10C in the conveying direction is contiguous with and in communication with another particular portion of the first conveyance guide 10A. The other particular portion of the first conveyance guide 10A is further to the front than the photosensitive drum 17.

The feed roller 11 is disposed at the upstream end portion of the first conveyance guide 10A in the conveying direction and above a front end portion of the feed tray 8.

The plurality of discharge rollers 12 is disposed at a downstream end portion of the first conveyance guide 10A in the conveying direction while facing the discharge tray 9. The discharge rollers 12 are in contact with each other. The plurality of discharge rollers 12 selectively rotates in one of a first direction in which the plurality of discharge rollers 12 rotates to discharge a sheet P onto the discharge tray 9 and a second direction in which the plurality of discharge rollers 12 rotates to convey a sheet P toward the second conveyance guide 10B.

The flatbed scanner 35 is disposed above the printer body 2 while being spaced apart from the discharge tray 9. The flatbed scanner 35 includes a retaining cover 35A, a glass surface 35B, and a charge coupled-sensor ("CCD") sensor 35C. The flatbed scanner 35 reads image information from a document placed between the retaining cover 35A and the glass surface 35B using the CCD sensor 35C.

The printer 1 starts an image forming operation under control of a controller (not depicted). As the image forming operation starts, the charging roller 19 charges the surface of the photosensitive drum 17 uniformly. The scanner unit 4 exposes the surface of the photosensitive drum 17 with a laser beam, thereby forming an electrostatic latent image on the surface of the photosensitive drum 17 based on image data. The photosensitive drum 17 supports the electrostatic latent image formed on the surface thereof.

The supply roller 26 supplies toner onto the developing roller 25 from the developing cartridge 16. At that time, toner is frictionally charged between the developing roller 25 and the supply roller 26 and is held by the developing roller 25. The layer-thickness regulating blade 27 regulates a thickness of a toner layer held by the developing roller 25 to a certain thickness.

The developing roller 25 then supplies toner to the electrostatic latent image held by the surface of the photosensitive drum 17 to develop a toner image on the surface of the photosensitive drum 17. Thus, the photosensitive drum 17 supports the toner image on the surface thereof.

One or more sheets P are fed one by one from the feed tray 8 at a predetermined timing by rotation of the feed roller 11. The sheet P is conveyed to the contact point N of the photosensitive drum 17 and the transfer roller 18 while being guided by the first conveyance guide 10A. The toner image held by the surface of the photosensitive drum 17 is transferred onto one of sides of the sheet P when the sheet P passes the contact point N.

Thereafter, the sheet P passes between the heat roller 30 and the pressing roller 31 while being guided by the first conveyance guide 10A. The sheet P is applied with heat and pressure when the sheet P passes between the heat roller 30 and the pressing roller 31, whereby the toner image formed on the sheet P is thermally fixed onto the sheet P. Then, the sheet P reaches the discharge rollers 12 and is thus discharged onto the discharge tray 9 by rotation of the discharge rollers 12 in the first direction.

In a case where an image is formed onto each side of a sheet P, the rotating direction of the discharge rollers 12 is switched to the second direction from the first direction when an upstream edge (e.g., a trailing edge) of the sheet P in the conveying direction reaches in front of the second conveyance guide 10B.

Upon switching of the rotating direction to the second direction, the conveying direction is reversed and the sheet P is conveyed toward the rear. Thus, the sheet P is conveyed into the second conveyance guide 10B. Then, the sheet P reaches the first conveyance guide 10A again while being guided by the second conveyance guide 10B, and then is further conveyed to the contact point N between the photosensitive drum 17 and the transfer roller 18.

Therefore, a toner image held by the photosensitive drum 17 is transferred onto the other side of the sheet P and thus the sheet P has the toner image formed on each side thereof. After that, as described above, the toner image is fixed onto the sheet P by the fixing unit 5 and then the sheet P is discharged onto the discharge tray 9 by rotation of the discharge rollers 12 in the first direction.

In a case where a sheet P is fed from the outside of the printer body 2, a sheet P is inserted into the inside of the printer body 2 through the sheet entry port 7A of the front cover 7. The inserted sheet P is guided by the third conveyance guide 10C and thus reaches the first conveyance guide 10A. Then, a toner image is transferred onto the sheet P while the sheet P passes the contact point N of the photosensitive drum 17 and the transfer roller 18 as described above. Thereafter, the toner image is fixed onto the sheet P by the fixing unit 5 and then the sheet P is discharged onto the discharge tray 9 by rotation of the discharge rollers 12 in the first direction.

During the image forming operation, extraneous matters, e.g., residual toner and paper dust, may adhere to the surface of the photosensitive drum 17. In a case where such extraneous matters adhere to the surface of the photosensitive drum 17, the scraper blade 23 scrapes the extraneous matters from the surface of the photosensitive drum 17 while the photosensitive drum 17 rotates. The scraped extraneous matters fall into the residual toner storage 22 through the opening 22A of the residual toner storage 22 and stored therein.

The extraneous matters may move to the surface of the charging roller 19 from the photosensitive drum 17. When such a case occurs, the cleaning roller 20 collects the extraneous matters from the surface of the charging roller 19 and holds the extraneous matters thereon.

2. Details of Drum Cartridge

Figures 4A, 4B:
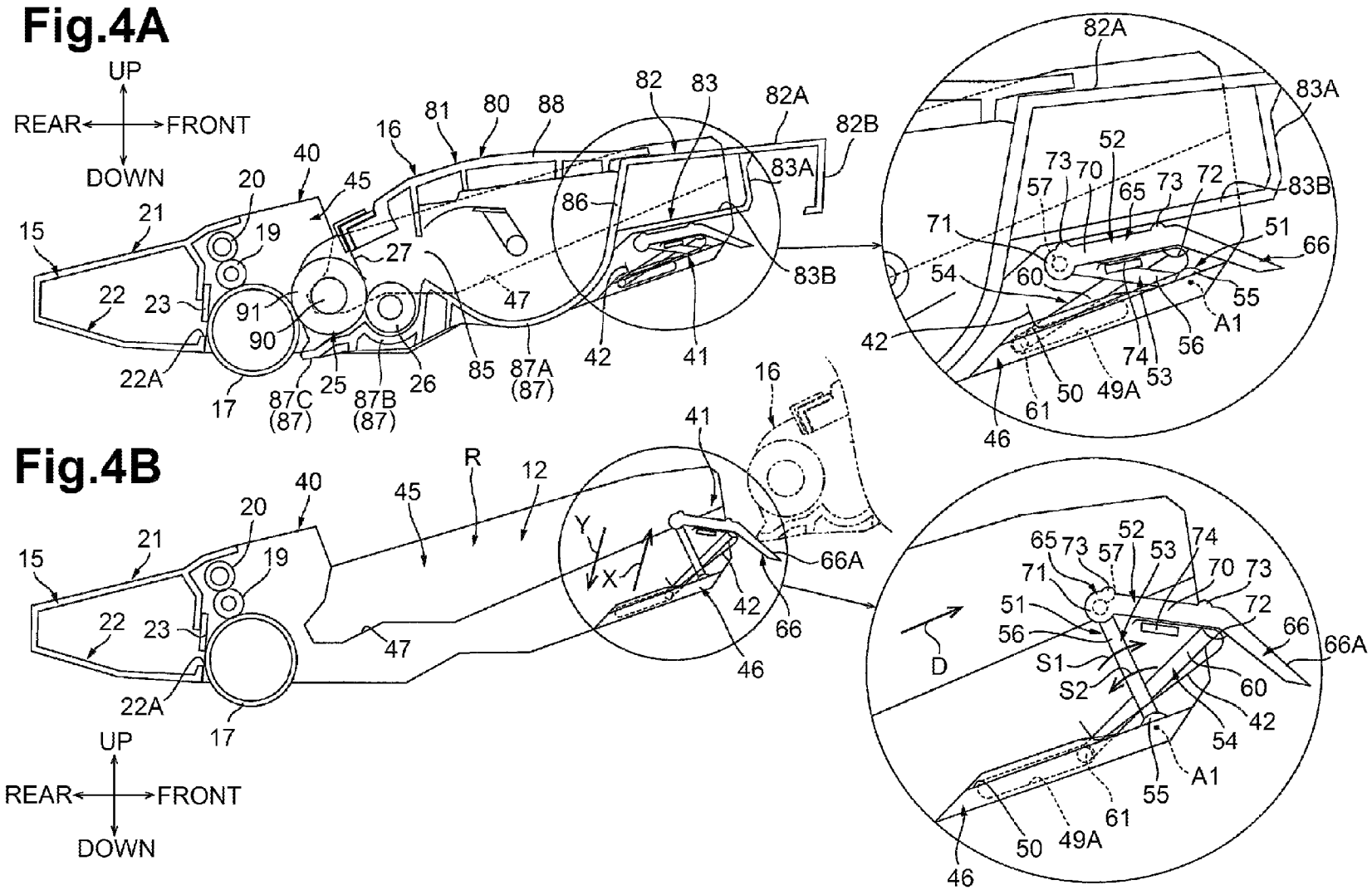
FIG. 4A is a central cross-sectional view depicting the drum cartridge and the developing cartridge of FIG. 1 in the first illustrative embodiment according to one or more aspects of the disclosure.
FIG. 4B is a central cross-sectional view depicting the drum cartridge of FIG. 4A in the first illustrative embodiment according to one or more aspects of the disclosure.

As depicted in FIG. 4B, the drum cartridge 15 includes a cartridge frame 40, a handle unit 41 (as an example of a handle, a second pressing mechanism, and a pressing mechanism), and a spring member 42 (as an example of an urging member, a second pressing mechanism, and a pressing mechanism).

The cartridge frame 40 includes right and left sidewalls 45 and a handle supporting wall 46.

The right and left sidewalls 45 define right and left ends of the cartridge frame 40 while being spaced apart from each other in the right-left direction. The sidewalls 45 have a substantially rectangular plate-like shape in side view extending in the front-rear direction. The right and left sidewalls 45 each have a receiving groove 47.

As depicted in FIG. 4A, the right receiving groove 47 is defined in an inner surface of the right sidewall 45 in the right-left direction. The right receiving groove 47 is recessed toward the exterior of the printer 1 (e.g., rightward) relative to the inner surface of the right sidewall 45 in the right-left direction. The right receiving groove 47 extends obliquely downward toward the rear from an upper end of a frontward portion of the right sidewall 45. A lower rear end portion of the receiving groove 47 is disposed obliquely above to the front of the photosensitive drum 17 while being spaced apart from the photosensitive drum 17 when viewed in the right-left direction. The lower rear end portion of the receiving groove 47 has a substantially U shape in side view such that the lower rear end portion opens obliquely upward toward the front. The left receiving groove 47 (not depicted) may be defined in the left side wall 45 in the right left direction. The left receiving groove 47 includes the same or similar configuration to the right receiving groove 47.

Figure 5:
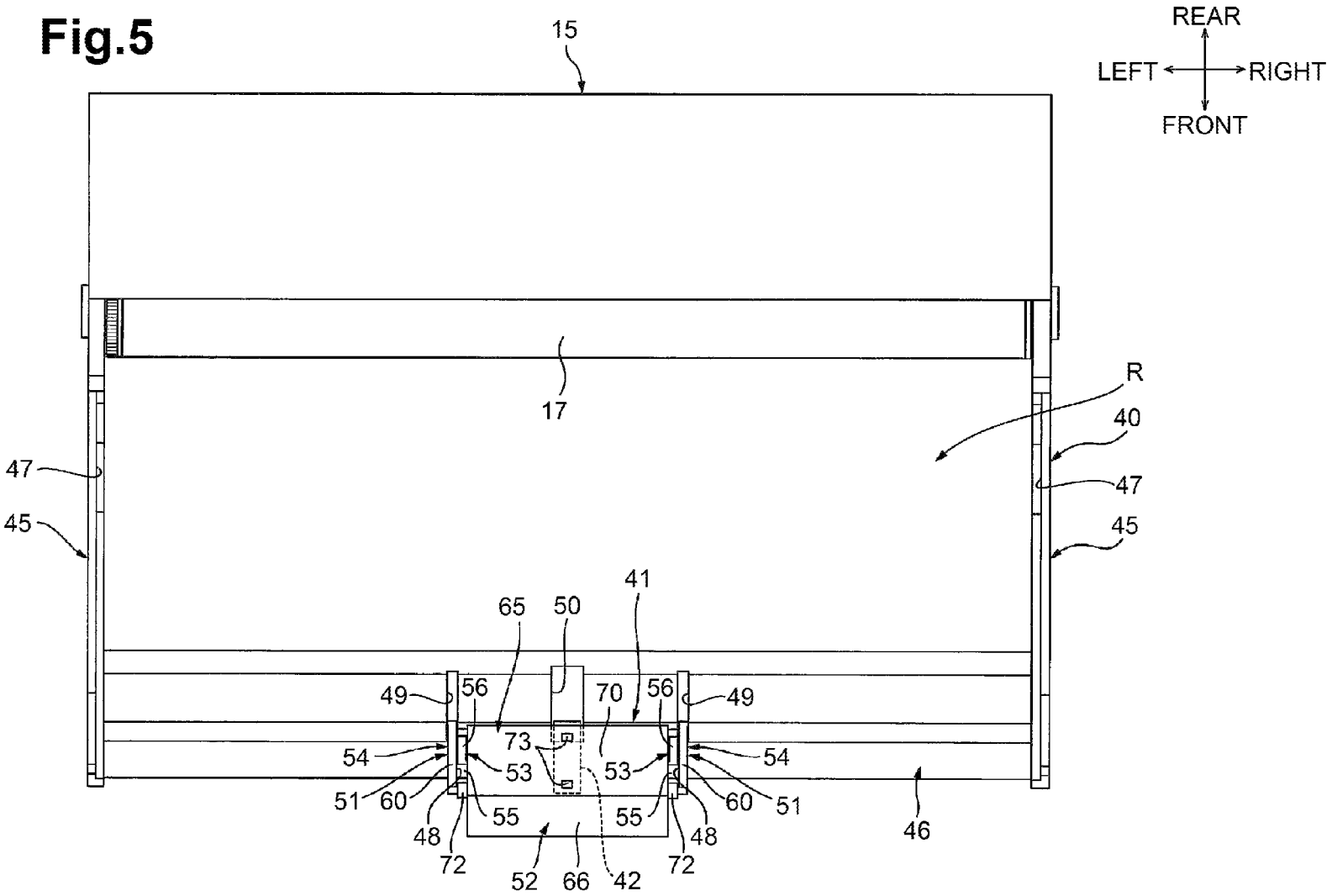
FIG. 5 is a plan view depicting the drum cartridge of FIG. 4B in the first illustrative embodiment according to one or more aspects of the disclosure.

The handle supporting wall 46 is disposed between lower front end portions of the right and left sidewalls 45 while bridging therebetween. As depicted in FIG. 4B, the handle supporting wall 46 extends obliquely downward toward the rear from a front end of the right sidewall 45. As depicted in FIG. 5, the handle supporting wall 46 also extends in the right-left direction in plan view.

The handle supporting wall 46 has right and left first grooves 48, a spring groove 50, right and left second grooves 49.

The first grooves 48 are defined in a frontward portion of an upper surface of the handle supporting wall 46 while being spaced apart from each other in the right-left direction so as to be disposed on opposite sides of a middle portion of the handle supporting wall 46 in the right-left direction. The first grooves 48 are recessed downward relative to the upper surface of the handle supporting wall 46 and have a substantially rectangular shape in plan view.

The spring groove 50 is defined in a rearward portion of the upper surface of the handle supporting wall 46 and in the middle portion of the handle supporting wall 46 in the right-left direction. The spring groove 50 is recessed downward relative to the upper surface of the handle supporting wall 46. The spring groove 50 has a substantially rectangular shape in plan view extending in the front-rear direction.

The second grooves 49 are defined in the rearward portion of the handle supporting wall 46 while being spaced apart from each other in the right-left direction so as to be disposed on opposite sides of the spring groove 50. A distance between the second grooves 49 in the right-left direction may be slightly longer than a distance between the first grooves 48 in the right-left direction. The second grooves 49 are recessed downward relative to the upper surface of the handle supporting wall 46 and have a substantially rectangular shape in plan view extending in the front-rear direction.

As depicted in FIG. 4B, the right second groove 49 has a right guide groove 49A. The right guide groove 49A is defined in a right inner surface of the right second groove 49 in the right-left direction. The right guide groove 49A is recessed toward the exterior of the printer 1 (e.g., rearward) relative to the right inner surface of the right second groove 49 in the right-left direction. The right guide groove 49A extends obliquely upward toward the front and has a substantially oval shape in side view. The left second groove 49 also has a left guide groove 49A. The left guide groove 49A includes the same or similar configuration to the right guide groove 49A except the left guide groove 49A is recessed toward the opposite direction.

As depicted in FIGS. 4B and 5, the handle unit 41 is disposed at a substantially middle portion of the upper surface of the handle supporting wall 46 in the right-left direction. The handle unit 41 constitutes a pantograph mechanism and includes right and left movable mechanisms 51 and a handle body 52 (as an example of a handle body).

Figure 3:
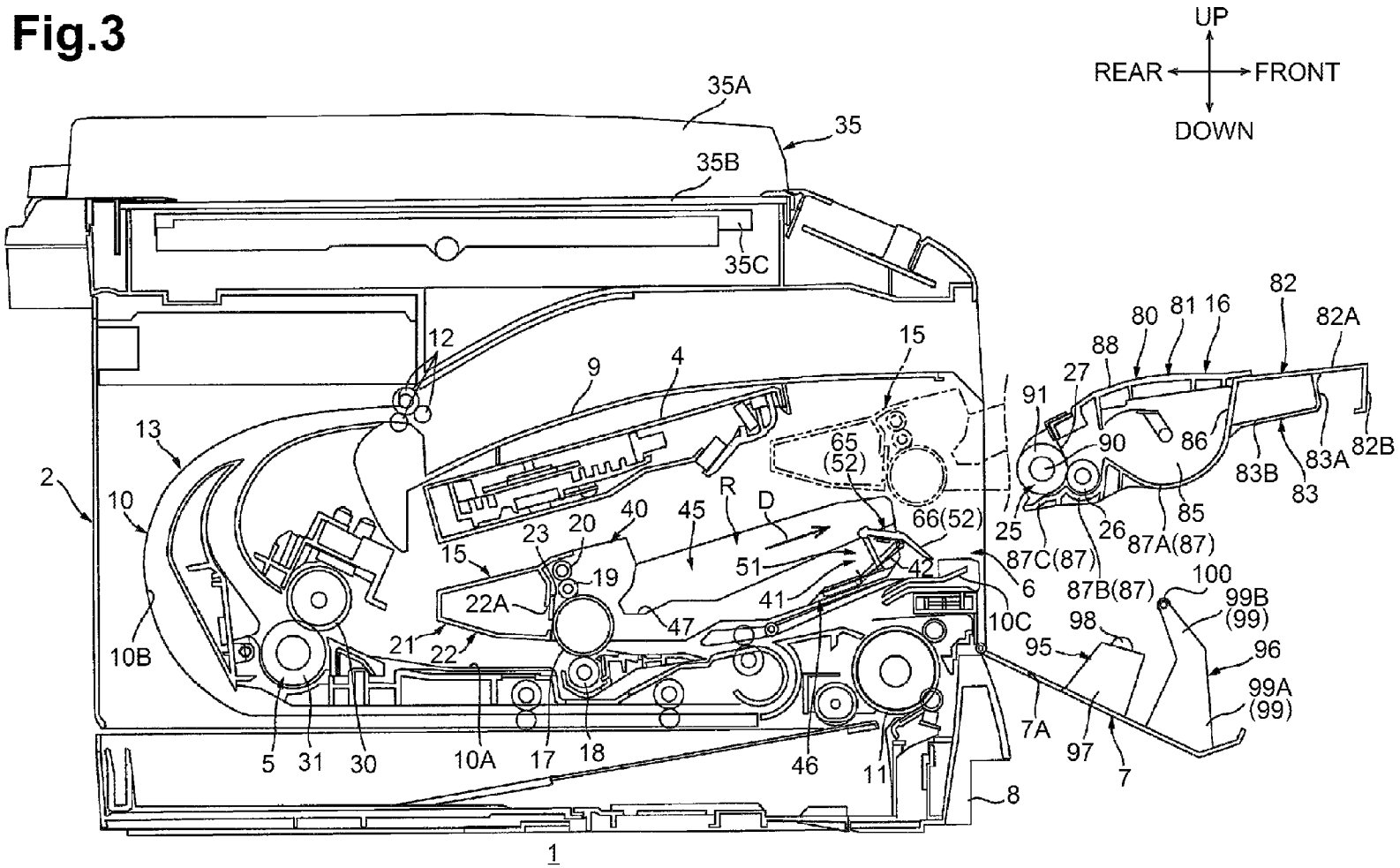
FIG. 3 is a central cross-sectional view depicting the printer of FIG. 1 in the first illustrative embodiment according to one or more aspects of the disclosure, wherein a developing cartridge is detached from a drum cartridge.

As depicted in FIGS. 1 and 3, the handle unit 41 is movable between a protruding position (e.g., a position of the handle unit 41 depicted in FIG. 3) and a retracted position (e.g., a position of the handle unit 41 depicted in FIG. 1). When the handle unit 41 is located at the protruding position (refer to FIG. 3), the handle unit 41 protrudes toward an attaching/detaching path R used for attaching and detaching the developing cartridge 16 to and from the drum cartridge 15. When the handle unit 41 is located at the retracted position (refer to FIG. 1), the handle unit 41 is located farther from the attaching/detaching path R than the handle unit 41 that is located at the protruding position.

Hereinafter, the handle unit 41 will be described in detail with reference to a state where the handle unit 41 is located at the protruding position as depicted in FIGS. 3, 4B, and 5.

As depicted in FIG. 5, the right and left movable mechanisms 51 constitute right and left end portions, respectively, of the handle unit 41 and support right and left end portions, respectively, of the handle body 52. As depicted in FIG. 4B, the right and left movable mechanisms 51 coincide with each other in the right-left direction while being spaced apart from each other in the right-left direction. The right and left movable mechanisms 51 each include a connecting portion 53 and a supporting portion 54.

As depicted in FIG. 4B, the right connecting portion 53 includes a right connecting bar 56, a right pivot shaft 55 (as an example of a shaft portion), and a right connecting shaft 57, which are integral with each other or consist of one piece.

The right connecting bar 56 has a substantially rectangular column shape and extends obliquely upward toward the rear from the right pivot shaft 55.

The right pivot shaft 55 is disposed at a lower end of the right connecting portion 53. The right pivot shaft 55 has a substantially circular column shape extending in the right-left direction. The right pivot shaft 55 is connected with the lower end of the right connecting bar 56 at an upper rear portion of a peripheral surface of the right pivot shaft 55. As depicted in FIG. 5, a dimension of the right pivot shaft 55 in the right-left direction is substantially the same as a dimension of the right first groove 48 in the right-left direction.

As depicted in FIG. 4B, the right connecting shaft 57 is disposed at an upper end portion of the right connecting portion 53. The right connecting shaft 57 is disposed at a left surface of the upper end portion of the right connecting bar 56 in the right-left direction. The right connecting shaft 57 has a substantially circular column shape. The right connecting shaft 57 protrudes leftward from the left surface of the right connecting bar 56 in the right-left direction.

The right connecting portion 53 is supported by the cartridge frame 40 while the right pivot shaft 55 is disposed in the right first groove 48 through insertion into the right first groove 48 and the right pivot shaft 55 is rotatably retained by the handle supporting wall 46. With this configuration, the connecting portion 53 is pivotable on an axis A1 of the pivot shaft 55. Although the explanation has been made with reference to the right connecting portion 53, the left connecting portion 53 has the same or similar configuration to the right connection portion 53 and behaves in the same or similar manner.

As depicted in FIG. 5, the right and left supporting portions 54 are disposed nearer to the exterior of the printer 1 than the right and left connecting portions 53, respectively, in the right-left direction while being disposed adjacent to the right and left connecting portions 53, respectively, in the right-left direction. As depicted in FIG. 4B, the right supporting portion 54 includes a right supporting bar 60, a right slide shaft 61, and a right supporting shaft (not depicted), which are integral with each other or consist of one piece.

The right supporting bar 60 has a substantially rectangular column shape and extends obliquely upward toward the front from the right slide shaft 61. A dimension of the right supporting bar 60 in the right-left direction is substantially the same as a dimension of the right second groove 49 in the right-left direction.

The right slide shaft 61 is disposed at a lower end of the supporting portion 54. The right slide shaft 61 is disposed at a right surface of the lower end of the right supporting bar 60 in the right-left direction. The right slide shaft 61 has a substantially circular column shape. The slide shaft 61 protrudes rightward from the right surface of the right supporting bar 60 in the right-left direction.

The right supporting shaft is disposed at an upper end portion of the right supporting portion 54. The right supporting shaft is disposed at a left surface of the upper end portion of the right supporting bar 60 in the right-left direction. The right supporting shaft has a substantially circular column shape. The supporting shaft protrudes leftward from the left surface of the right supporting bar 60 in the right-left direction.

The right supporting portion 54 is supported by the cartridge frame 40 while the lower end portion of the right supporting bar 60 is disposed in the right second groove 49 through insertion into the right second groove 49 and the right slide shaft 61 is disposed in the right guide groove 49A through insertion into the right guide rove 49A. This configuration may enable the lower end portion of the right supporting portion 54 to slide along the right guide groove 49A while the right slide shaft 61 is guided by the right guide groove 49A. The right supporting portion 54 is pivotable on an axis of the right slide shaft 61. Although the explanation has been made with referent the right supporting portion 54, the left supporting portion 54 has the same or similar configuration to the right supporting portion 54 and behaves in the same or similar manner.

The handle body 52 constitutes a top portion of the handle unit 41. As depicted in FIG. 5, the handle body 52 has a substantially rectangular shape in plan view extending in the right-left direction. The handle body 52 includes a contact portion 65 and a grip portion 66, which are integral with each other or consist of one piece.

As depicted in FIG. 4B, the contact portion 65 constitutes a rear portion of the handle body 52. The contact portion 65 includes a plate-shaped portion 70, a circular column portion 71, right and left hollow cylindrical portions 72, a plurality of protrusions 73, and a spring retaining portion 74, which are integral with each other or consist of one piece.

As depicted in FIG. 4B, the plate-shaped portion 70 extends obliquely downward toward the front in side view from the circular column portion 71.

The circular column portion 71 is disposed at a rear end of the contact portion 65. The circular column portion 71 has a substantially circular cylindrical shape extending in the right-left direction. The circular column portion 71 is connected with a rear end of the plate-shaped portion 70 at an upper front portion of a peripheral surface of the circular column portion 71.

The circular column portion 71 has bearing holes (not depicted) corresponding to the right and left connecting shafts 57 of the right and left connecting portions 53, respectively. The bearing holes are defined in respective right and left end faces of the circular column portion 71. The bearing holes have a substantially circular shape in side view. The bearing holes each have an axis that is coaxial with an axis of the circular column portion 71. The bearing holes are recessed toward the center of the circular column portion 71 relative to the respective end faces in the right-left direction of the circular column portion 71. An inside diameter of each of the bearing holes is substantially the same as an outside diameter of each of the connecting shafts 57.

As depicted in FIG. 5, the right and left hollow cylindrical portions 72 are disposed on opposite sides of a front end portion of the plate-shaped portion 70 in the right-left direction. The hollow cylindrical portions 72 have a substantially circular cylindrical shape extending in the right-left direction. The right and left hollow cylindrical portions 72 protrude from the respective right and left sides of the front end portion of the plate-shaped portion 70 toward the exterior of the printer 1 in the right-left direction. A dimension in the right-left direction of each of the hollow cylindrical portions 72 is slightly greater than a dimension in the right-left direction of each of the connecting bars 56. An inside diameter of each of the hollow cylindrical portions 72 is substantially the same as an outside diameter of each of the supporting shafts (not depicted).

The plurality of protrusions 73 may include, for example, two protrusions 73. The protrusions 73 are disposed at a substantially middle portion of an upper surface of the plate-shaped portion 70 in the right-left direction. The protrusions 73 are spaced apart from each other in the front-rear direction. As depicted in FIG. 4B, the protrusions 73 have a substantially semicircular arc shape in side view and protrude obliquely upward toward the front from the upper surface of the plate-shaped portion 70.

The spring retaining portion 74 is disposed diagonally below to the rear of the plate-shaped portion 70 while being spaced from the plate-shaped portion 70. The spring retaining portion 74 has a substantially plate-like shape extending in the right-left direction. At least one of right and left end portions of the spring retaining portion 74 is connected with a lower surface of the plate-shaped portion 70.

The grip portion 66 constitutes a front portion of the handle body 52. The grip portion 66 extends contiguously from a front end of the plate-shaped portion 70. The grip portion 66 is inclined downward toward the front at an inclination angle greater than the plate-shaped portion 70.

The handle body 52 is supported by the right and left movable mechanisms 51 while the connecting shafts 57 of the connecting portions 53 are disposed in the bearing holes of the circular column portions 71, respectively, so as to be rotatable relative to each other and the supporting shafts of the supporting portions 54 are disposed in the hollow cylindrical portions 72, respectively, so as to be rotatable relative to each other.

That is, each of the right connecting portion 53 and the right supporting portion 54 supports the right end portion of the handle body 52 and each of the left connecting portion 53 and the left supporting portion 54 supports the left end portion of the handle body 52. The upper end portion of each of the connecting portions 53 and the supporting portions 54 are pivotably retained by the handle body 52. The connecting bars 56 of the connecting portions 53 intersect the supporting bars 60 of the supporting portion 54 in the right-left direction.

The spring member 42 may be a known leaf spring. The spring member 42 has a substantially V-letter shape in side view and opens obliquely downward toward the rear. A lower end portion of the spring member 42 is bent obliquely upward toward the rear. The spring member 42 is disposed between the handle supporting wall 46 and the plate-shaped portion 70 of the handle body 52 while a lower end portion of the spring member 42 is disposed in the spring groove 50 and an upper end portion of the spring member 42 is interposed between and retained by the plate-shaped portion 70 and the spring retaining portion 74.

With this configuration, the spring member 42 urges the plate-shaped portion 70 of the handle body 52 obliquely upward toward the front at all times and the handle unit 41 toward the protruding position at all time.

3. Details of Developing Cartridge

As depicted in FIG. 4A, the developing cartridge 16 includes a cartridge frame 80.

The cartridge frame 80 includes a frame body 81, a developing-cartridge handle 82, and a contact unit 83 (as an example of a contact portion).

The frame body 81 has a substantially box shape with its rear end opened and stores toner therein.

The frame body 81 includes right and left sidewalls 85, a front wall 86, a bottom wall 87, and a top wall 88.

The right and left sidewalls 85 define right and left ends of the frame body 81 while being spaced apart from each other in the right-left direction. The right and left sidewalls 85 have a substantially rectangular plate-like shape in side view extending in the front-rear direction.

The front wall 86 defines a front end of the frame body 81 and is disposed between a front end portion of the right sidewall 85 and a front end portion of the left sidewall 85 while bridging therebetween.

The bottom wall 87 defines the bottom of the frame body 81 and is disposed between a lower end portion of the right sidewall 85 and a lower end portion of the left sidewall 85 while bridging therebetween. A front end of the bottom wall 87 is contiguous with a lower end of the front wall 86.

The bottom wall 87 includes a curved portion 87A, an arc portion 87B, and a lip portion 87C, which are integral with each other or consist of one piece.

The curved portion 87A constitutes a frontward portion of the bottom wall 87. The curved portion 87A extends rearward contiguously from the lower end of the front wall 86. The curved portion 87A is concave downward at a substantially middle portion thereof in the front-rear direction.

The arc portion 87B has a substantially semicircular arc shape in side view and opens upward. The arc portion 87B has an inner surface that extends along an outer circumferential surface of the supply roller 26. A front end of the arc portion 87B is contiguous with a rear end of the curved portion 87A. The lip portion 87C extends obliquely downward toward the rear contiguously from a rear end of the arc portion 87B.

The top wall 88 defines the top of the frame body 81. The top wall 88 has a substantially rectangular plate-like shape in plan view extending in the right-left direction. The top wall 88 has right and left ends that are connected with the upper ends of the right and left sidewalls 85, respectively. The top wall 88 has a front end portion that is connected with the upper end of the front wall 86. The top wall 88 has a rear end that is located upwardly remote from the arc portion 87B of the bottom wall 87.

The frame body 81 supports the developing roller 25, the supply roller 26, and the layer-thickness regulating blade 27.

The developing roller 25 is disposed above the lip portion 87C of the bottom wall 87 while being spaced therefrom. The developing roller 25 includes a roller shaft 90, a roller body 91, and a plurality of, for example, two, collars (not depicted).

The roller shaft 90 has a substantially circular column shape extending in the right-left direction. Right and left end portions of the roller shaft 90 are rotatably supported by the right and left sidewalls 85, respectively. Thus, the developing roller 25 is rotatably supported by the frame body 81. The right and left end portions of the roller shaft 90 protrude from the respective sidewalls 85 in the right-left direction toward the exterior of the printer 1.

The roller body 91 has a substantially circular cylindrical shape extending in the right-left direction. A dimension in the right-left direction of the roller body 91 is smaller than a dimension in the right-left direction of the roller shaft 90. The roller body 91 covers a portion of the roller shaft 90 and is disposed between a rear end portion of the right sidewall 85 and a rear end portion of the left sidewall 85.

The collars are provided for the right and left end portions, respectively, of the roller shaft 90. The collars are engaged with the respective end portions of the roller shaft 90 in the right-left direction so as to be rotatable relative to the roller shaft 90 while being disposed nearer to the exterior of the printer 1 than the respective sidewalls 85 in the right-left direction.

The supply roller 26 is disposed diagonally below to the front of the developing roller 25 and at the arc portion 87B of the bottom wall 87. More specifically, an axis of the supply roller 26 is disposed lower than and further to the front of an axis of the developing roller 25. The supply roller 26 has a substantially circular column shape extending in the right-left direction. The supply roller 26 is supported by the frame body 81 while right and left end portions of the supply roller 26 are rotatably supported by the right and left sidewalls 8, respectively.

The layer-thickness regulating blade 27 is fixed to the rear end of the top wall 88. A lower end portion of the layer-thickness regulating blade 27 is in contact with a front end portion of the roller body 91 of the developing roller 25.

The developing-cartridge handle 82 is disposed at the front of the developing cartridge 16. The developing-cartridge handle 82 has a substantially plate-like shape having a substantially L shape in side view. The developing-cartridge handle 82 includes an extended portion 82A and a grip portion 82B, which are integral with each other or consist of one piece.

The extended portion 82A extends contiguously from the upper end of the front wall 86. The grip portion 82B extends downward contiguously from a front end of the extended portion 82A.

The developing-cartridge handle 82 has a cutaway portion (not depicted) at a particular position corresponding to a pressing unit 95.

The contact unit 83 is disposed below the extended portion 82A of the developing-cartridge handle 82. The contact unit 83 has a substantially plate-like shape having a substantially L shape in side view. The contact unit 83 includes a pressed portion 83A and a contact portion 83B.

The pressed portion 83A extends downward from a substantially middle portion of a lower surface of the extended portion 82A in the front-rear direction. The contact portion 83B extends obliquely downward toward the rear contiguously from a lower end of the pressed portion 83A. A rear end of the contact portion 83B is connected with the front wall 86 of the frame body 81.

The developing cartridge 16 having the above configuration is joined to the drum cartridge 15 while the collars of the developing roller 25 are disposed in the respective receiving grooves 47. In a state where the developing cartridge 16 is joined to the drum cartridge 15, the contact unit 83 is located above the handle unit 41 and in contact with the protrusions 73 from above.

4. Details of Printer Body

As depicted in FIG. 1, the printer body 2 includes the pressing unit 95, a restraining member 96 (as an example of a pressing member). The pressing unit 95 and the restraining member 96 are disposed at the front cover 7.

Hereinafter, the pressing unit 95 and the restraining member 96 will be described in detail with reference to a state where the front cover 7 is located at the closing position as depicted in FIG. 1.

The pressing unit 95 is disposed at a substantially middle portion of a rear surface of the front cover 7 in the up-down direction. The pressing unit 95 includes a base portion 97 and a pressing portion 98 (as an example of a first pressing mechanism).

The base portion 97 has a substantially trapezoidal shape in side view. The base portion 97 is tapered toward the rear. The base portion 97 protrudes rearward from the rear surface of the front cover 7 while extending in the right-left direction.

The pressing portion 98 is disposed at a rear surface of the base portion 97. The pressing portion 98 protrudes rearward and has a substantially semicircular arc shape in side view. The pressing portion 98 is movable in the front-rear direction. The pressing portion 98 is urged rearward by a spring (not depicted) at all times.

The pressing portion 98 is in contact with the pressed portion 83A of the contact unit 83 of the developing cartridge 16 from the front. Thus, the developing cartridge 16 is urged toward the photosensitive drum 17 at all times.

The restraining member 96 is disposed at the rear surface of the front cover 7. The restraining member 96 is disposed above the pressing unit 95 and spaced apart from the pressing unit 95. The restraining member 96 includes a roller supporting portion 99 and a roller 100.

The roller supporting portion 99 protrudes rearward from the rear surface of the front cover 7. The roller supporting portion 99 includes a first portion 99A and a second portion 99B, which are integral with each other or consist of one piece. The first portion 99A consists of a frontward portion of the roller supporting portion 99. The first portion 99A has a substantially trapezoidal shape in side view and is tapered toward the rear. The second portion 99B consists of a rearward portion of the roller supporting portion 99. The second portion 99B is angled relative to the first portion 99A and extends obliquely downward toward the rear from a rear end of the first portion 99A. The second portion 99B has a substantially trapezoidal shape in side view and is tapered toward obliquely downward toward the rear.

The roller 100 has a substantially circular column shape extending in the right-left direction. The roller 100 is rotatably supported by a lower rear end of the second portion 99B of the roller supporting portion 99.

The roller 100 is in contact with the extended portion 82A of the developing-cartridge handle 82 of the developing cartridge 16 from above.

Thus, the developing cartridge 16 is urged downward by the restraining member 96 to be retained at an attached position where the developing cartridge 16 is ought to be placed relative to the drum cartridge 15. The handle unit 41 is pressed downward by the restraining member 96 via the developing cartridge 16 and is located at the retracted position against an urging force of the spring member 42.

As depicted in FIG. 4A, in a state where the handle unit 41 is located at the retracted position, the slide shaft 61 of the right supporting portion 54 is located at a rear end of the right guide groove 49A and the right connecting bar 56 and the right supporting bar 60 are located near the handle supporting wall 46. In this state, the left slide shaft 61, the left connecting bar 56, and the left supporting bar 60 are also in the same or similar positions, respectively, on the left side, to the right slide shaft 61, the right connecting bar 56, and the right supporting bar 60.

Therefore, when the handle unit 41 is located at the retracted position, the handle body 52, the connecting portion 53, and the supporting portion 54 are folded.

5. Procedure for Detaching Developing Cartridge and Drum Cartridge from Printer Body A procedure for detaching the developing cartridge 16 and the drum cartridge 15 from the printer body 2 will be described. Hereinafter, an explanation will be made referring to the sectional views depicting the right portions of the printer 1, the drum cartridge 15, and the developing cartridge 16 and their components that are illustrated in the respective drawings (e.g., the components disposed on their right portions). Nevertheless, the same or similar components that are not illustrated in the drawings (e.g., the components disposed on the left portion of each of the printer body 2, the developing cartridge 16, and the drum cartridge 15) also behave in the same or similar manner to the corresponding right components and an explanation for the left components will be omitted.

For detaching the developing cartridge 16 and the drum cartridge 15 from the printer body 2, first, the developing cartridge 16 is detached from the printer body 2.

Figure 2:
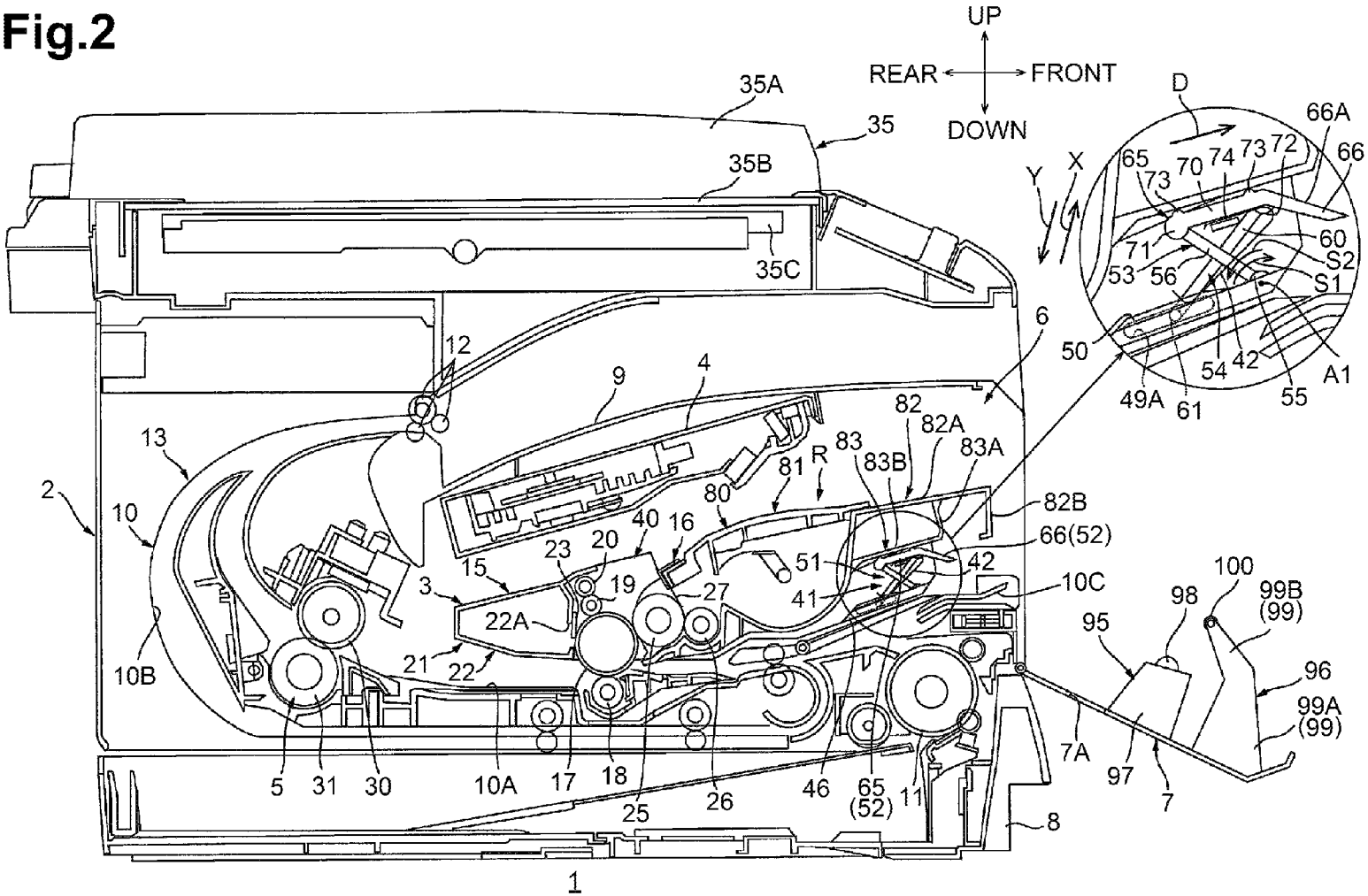
FIG. 2 is a central cross-sectional view depicting the printer of FIG. 1 in the first illustrative embodiment according to one or more aspects of the disclosure, wherein the front cover is located at an exposing position.

At a first step, as depicted in FIGS. 1 and 2, a user pivots the front cover 7 from the closing position to the exposing position. As the front cover 7 moves toward the exposing position, the pressing portion 98 of the pressing unit 95 is disengaged from the contact unit 83 of the developing cartridge 16 while the roller 100 of the restraining member 96 is disengaged from the developing-cartridge handle 82 of the developing cartridge 16.

In response to this, as depicted in FIG. 2, the handle body 52 and the right connecting portion 53 of the handle unit 41 pivot on the axis A1 of the right pivot shaft 55 in a first swing direction S1 (e.g., in a clockwise direction in left side view) by an urging force of the spring member 42. Thus, the upper end of the supporting bar 60 of the right supporting portion 54 moves obliquely upward toward the front and the slide shaft 61 of the right supporting portion 54 slides to a substantially middle portion of the right guide groove 49A in the front-rear direction in the right guide groove 49A.

Therefore, the handle unit 41 moves in a spring direction X (e.g., obliquely upward toward the front) from the retracted position and is thus located at a halfway position from the retracted position to the protruding position.

At that time, the contact portion 65 of the handle body 52 presses the contact portion 83B of the contact unit 83 of the developing cartridge 16 upward.

Therefore, the front portion of the developing cartridge 16 is moved upward. In response to this movement, the developing cartridge 16 slightly pivots in a counterclockwise direction in side view on the roller shaft 90, whereby the position of the developing cartridge 16 is changed from the attached position to a detachment-ready position. That is, the front portion of the developing cartridge 16 located at the detachment-ready position is pressed by the handle unit 41 and is thus located further downward in the spring direction X than the front portion of the developing cartridge 16 located at the attached position (refer to FIG. 1).

Thereafter, as depicted in FIG. 3, the user pulls the developing cartridge 16 obliquely upward toward the front by holding the grip portion 82B of the developing-cartridge handle 82.

Thus, the developing cartridge 16 is separated from the drum cartridge 15 and then detached from the printer body 2 through the opening 6.

As the developing cartridge 16 is separated from the drum cartridge 15, the contact portion 83B of the contact unit 83 is disengaged from the contact portion 65 of the handle body 52.

With this disengagement, as depicted in FIG. 4B, the handle body 52 and the connecting portion 53 further pivot in the first swing direction S1 by an urging force of the spring member 42, and the slide shaft 61 of the right supporting portion 54 slides to a front end of the right guide groove 49A.

Therefore, the connecting bar 56 of the connecting portion 53 and the supporting bar 60 of the supporting portion 54 move upward. Thus, the handle unit 41 further moves from the halfway position in the spring direction X toward the attaching/detaching path R, and is thus located at the protruding position.

That is, the handle unit 41 is retained at the protruding position by the urging force of the spring member 42 while the developing cartridge 16 is separated from the drum cartridge 15. The handle body 52 and the right connecting portion 53 pivot downward in the first swing direction S1, that is, in a detaching direction D (refer to FIG. 3) as the handle unit 41 moves from the retracted position to the protruding position.

Then, the drum cartridge 15 is detached from the printer body 2.

For detaching the drum cartridge 15 from the printer body 2, as depicted in FIG. 3, the user pulls the drum cartridge 15 obliquely upward toward the front by holding the grip portion 66 of the handle unit 41 that is located at the protruding position.

As the user pulls the drum cartridge 15, the drum cartridge 15 moves in the detaching direction D (e.g., obliquely upward toward the front). Thus, the drum cartridge 15 is detached from the printer body 2 through the opening 6.

Through the above procedure, the detachment of the developing cartridge 16 and the drum cartridge 15 from the printer body 2 is completed.

6. Procedure for Attaching Developing Cartridge and Drum Cartridge to Printer Body A procedure for attaching the developing cartridge 16 and the drum cartridge 15 to the printer body 2 will be described.

For attaching the developing cartridge 16 and the drum cartridge 15 to the printer body 2, the detaching procedure is performed in reverse order.

More specifically, the user moves the front cover 7 from the closing position to the exposing position to expose the opening 6. Then, the user inserts the drum cartridge 15 into the printer body 2 through the opening 6. Thus, the drum cartridge 15 is attached to the printer body 2.

Thereafter, the user inserts, through the opening 6, the developing cartridge 16 into the printer body 2 toward the drum cartridge 15 that is being attached to the printer body 2.

As depicted in FIG. 4B, during the insertion of the developing cartridge 16, the upper surface 66A of the grip portion 66 of the handle body 52 guides the attachment of the developing cartridge 16 to the drum cartridge 15. The upper surface 66A of the grip portion 66 is an example of a guide surface.

As the developing cartridge 16 comes into contact with the grip portion 66, the handle body 52 and the right connecting portion 53 pivot in a second pivoting direction S2 (e.g., in a counterclockwise direction in left side view) and the slide shaft 61 of the right supporting portion 54 slides obliquely downward toward the rear in the right guide groove 49A. Thus, the handle unit 41 moves from the protruding position in a receding direction Y (e.g., a direction opposite to the spring direction X) to recede from the attaching/detaching path R of the developing cartridge 16.

Thereafter, as depicted in FIG. 2, the developing cartridge 16 is further moved obliquely downward toward the front until the developing roller 25 comes into contact with the photosensitive drum 17.

Thus, the contact unit 83 of the developing cartridge 16 reaches an upper rear position relative to the handle unit 41 of the drum cartridge 15. Therefore, the contact portion 83B of the contact unit 83 comes into contact with the protrusions 73 of the contact portion 65 from upper rear.

That is, the contact unit 83 and the contact portion 65 are diagonally in contact with each other in a direction intersecting the detaching direction D.

Thus, the contact portion 65 is pressed downward by the weight of the developing cartridge 16 against the urging force of the spring member 42.

With the downward pressure of the contact portion 65, the handle body 52 and the right connecting portion 53 pivot in the second pivoting direction S2 on the axis A1 of the right pivot shaft 55 against the urging force of the right spring member 42. In response to this, the upper end of the supporting bar 60 of the right supporting portion 54 moves downward and the slide shaft 61 of the right supporting portion 54 slides in the right guide groove 49A obliquely downward toward the rear, thereby reaching a substantially middle portion of the right guide groove 49A in the front-rear direction.

Therefore, the handle unit 41 moves in the receding direction Y from the protruding position and reaches the halfway position, and the developing cartridge 16 is located at the detachment-ready position.

Thereafter, as depicted in FIG. 1, the user pivots the front cover 7 from the exposing position to the closing position.

As the front cover 7 moves to the closing position, the roller 100 of the restraining member 96 comes into contact with the extended portion 82A of the developing-cartridge handle 82 from above, whereby the restraining member 96 presses the developing cartridge 16 downward. That is, the restraining member 96 presses the developing cartridge 16 downward by contacting the developing-cartridge handle 82 from an opposite side to the handle unit 41 with respect to the developing cartridge 16.

Therefore, the handle body 52 of the handle unit 41 is pressed downward via the developing-cartridge handle 82 and the contact unit 83. In response to this, the handle body 52 and the right connecting portion 53 further pivot in the second pivoting direction S2 against the urging force of the right spring member 42, and the slide shaft 61 of the right supporting portion 54 further slides to the rear end of the right guide groove 49A.

Thus, the handle unit 41 moves in the receding direction Y to recede from the attaching/detaching path R. Accordingly, the handle unit 41 is located at the retracted position and the developing cartridge 16 is located at the attached position.

That is, in a state where the developing cartridge 16 is joined to the drum cartridge 15, the handle unit 41 is in contact with the contact unit 83, thereby the handle unit 41 is located at the retracted position against the urging force of the spring member 42. The handle unit 41 is movable between the protruding position and the retracted position in the direction intersecting the detaching direction D, and more specifically, both in the spring direction X and in the receding direction Y as depicted in FIG. 4B. The handle body 52 and the right connecting portion 53 are pivotable between the protruding position and the retracted position on the axis A1 of the right pivot shaft 55.

In a state where the developing cartridge 16 is located at the attached position, as depicted in FIG. 1, the pressing portion 98 of the pressing unit 95 is in contact with the contact portion 83B of the contact unit 83 from the front. Therefore, the developing cartridge 16 is pressed toward the photosensitive drum 17, and the developing roller 25 and the photosensitive drum 17 are in pressure contact with each other at all times.

7. Effects (1) In the printer 1, as depicted in FIG. 2, the developing cartridge 16 is located downstream of the photosensitive drum 17 in the detaching direction D in a state where the developing cartridge 16 is joined to the drum cartridge 15. Generally, the life of the developing cartridge 16 that stores toner therein may be shorter than the life of the drum cartridge 15 including the photosensitive drum 17. Thus, a replacement frequency of the developing cartridge 16 may be higher than a replacement frequency of the drum cartridge 15.

Therefore, the user may readily access the developing cartridge 16 that may be replaced with a new one frequently, thereby attaching and detaching the developing cartridge 16 to and from the printer body 2 smoothly.

As depicted in FIG. 3, as the developing cartridge 16 is separated from the drum cartridge 15, the handle unit 41 of the drum cartridge 15 moves toward the attaching/detaching path R by the urging force of the spring member 42 of the handle unit 41. Thus, the handle unit 41 is retained at the protruding position.

That is, in a state where the developing cartridge 16 is separated from the drum cartridge 15, the handle unit 41 protrudes toward the space for attaching or detaching the developing cartridge 16 to or from the drum cartridge 15.

Thus, in a state where the developing cartridge 16 is separated from the drum cartridge 15 in the printer body 2, (more specifically, in a state where the developing cartridge 16 is out of the printer body 2), the user may access the handle unit 41 readily and may detach the drum cartridge 15 from the printer body 2 smoothly.

In particular, as depicted in FIG. 5, the handle unit 41 is disposed at the substantially middle portion of the drum cartridge 15 in the right-left direction.

With this configuration, the user may clearly recognize the position of the grip portion 66 of the handle unit 41 or where the user holds as compared with a case where a handle of the drum cartridge 15 is disposed at each of right and left portions of the drum cartridge 15 such that the handles are out of the attaching/detaching path R. Therefore, the user may detach the drum cartridge 15 from the printer body 2 by holding the grip portion 66 of the handle unit 41 with one hand.

(2) As depicted in FIG. 4B, the handle unit 41 is movable between the protruding position and the retracted position in the direction intersecting the detaching direction D, and more specifically, both in the spring direction X and in the receding direction Y.

Therefore, as the developing cartridge 16 comes into contact with the handle unit 41 at the time of attaching or detaching the developing cartridge 16 to or from the drum cartridge 15, the handle unit 41 moves in the receding direction Y so as to recede from the attaching/detaching path R. This configuration may thus reduce or prevent the handle unit 41 from obstructing the attachment or detachment of the developing cartridge 16 to or from the drum cartridge 15.

(3) As depicted in FIG. 1, in a state where the developing cartridge 16 is joined to the drum cartridge 15, the handle unit 41 is located at the retracted position. Therefore, less space may be required for disposing the handle unit 41, whereby the printer 1 may be reduced in size.

As depicted in FIG. 3, as the developing cartridge 16 is separated from the drum cartridge 15, the handle unit 41 moves from the retracted position to the protruding position. Therefore, while the handle unit 41 is retained at the retracted position in a state where the developing cartridge 16 is joined to the drum cartridge 15, the drum cartridge 15 may be surely detached from the printer body 2 smoothly.

(4) As depicted in FIG. 4A, the developing cartridge 16 includes the contact unit 83. Therefore, in a state where the developing cartridge 16 is joined to the drum cartridge 15, the handle unit 41 may be surely retained at the retracted position.

The contact unit 83 and the handle unit 41 contact with each other in the direction intersecting the detaching direction D. This configuration may thus reduce or prevent the handle unit 41 from obstructing the attachment or detachment of the developing cartridge 16 to or from the drum cartridge 15.

(5) As depicted in FIG. 2, as the handle unit 41 moves from the retracted position to the protruding position, the handle unit 41 pivots downstream in the detaching direction D. Thus, the handle unit 41 located at the protruding position is located further downstream than the handle unit 41 located at the retracted position in the detaching direction D. Therefore, the user may surely access the handle unit 41 located at the protruding position from downstream of the printer body 2 in the detaching direction D, that is, from the front of the printer 1.

As the developing cartridge 16 comes into contact with the handle unit 41 at the time of attaching or detaching the developing cartridge 16 to or from the drum cartridge 15, the handle unit 41 pivots upstream in the detaching direction D. This configuration may thus further surely reduce or prevent the handle unit 41 from obstructing the attachment or detachment of the developing cartridge 16 to or from the drum cartridge 15.

(6) As depicted in FIG. 4B, the upper end portion of the right connecting portion 53 is fixed to the handle body 52 such that the right connecting portion 53 is pivotable, and the lower end portion of the right connecting portion 53 includes the right pivot shaft 55. The left connecting portion 53 have the same or similar configuration to the right connecting portion 53. Therefore, the handle body 52 and the connecting portions 53 may be folded by pivoting on their connecting shafts 57 of the connecting portions 53.

With this configuration, in a state where the handle unit 41 is located at the retracted position, the handle body 52 and the connecting portion 53 may be surely located out of the attaching/detaching path R.

As the handle unit 41 moves from the retracted position to the protruding position to pivot downward in the detaching direction D, the handle body 52 including the grip portion 66 moves downward in the detaching direction D. Therefore, the user may surely hold the grip portion 66 of the handle unit 41 located at the protruding position, from the front of the printer body 2.

(7) As depicted in FIG. 4B, the handle unit 41 includes the right supporting portion 54 for supporting the handle body 52. The handle unit 41 further includes the left supporting portion 54 (not depicted) for supporting the handle body 52. Therefore, this configuration may reduce or prevent the handle body 52 from pivoting on the connecting shafts 57 of the connecting portions 53 when the handle unit 41 pivots between the retracted position and the protruding position. Accordingly, the handle body 52 may be surely moved downstream in the detaching direction D.

(8) As depicted in FIGS. 4A and 4B, the right supporting portion 54 intersects the right connecting portion 53 in the right-left direction. The upper end portion of the right supporting portion 54 is rotatably fixed to the handle body 52 and the lower end portion of the right supporting portion 54 is supported by the drum cartridge 15 so as to be pivotable and slidable.

With this configuration, in a state where the handle unit 41 is located at the retracted position, the handle body 52, the connecting portion 53, and the supporting portion 54 may be folded and surely located out of the attaching/detaching path R.

As the handle unit 41 moves from the retracted position toward the protruding position, the right connecting portion 53 pivots downstream in the detaching direction D on the right pivot shaft 55 while the lower end portion of the right supporting portion 54 slides downstream in the detaching direction D. In response to this, the right connecting portion 53 and the right supporting portion 54 move upward and the handle body 52 surely moves toward the attaching/detaching path R. As the handle unit 41 moves from the retracted position toward the protruding position, the left connecting portion 53 (not depicted) behaves in the same or similar manner to the right connecting portion 53.

That is, while a stable movement of the handle unit 41 between the retracted position and the protruding position may be ensured, the handle body 52 may be surely moved toward the attaching/detaching path R at the time of moving the handle unit 41 from the retracted position to the protruding position.

(9) As depicted in FIG. 1, the restraining member 96 presses the developing cartridge 16 being joined to the drum cartridge 15 against the urging force of the spring member 42. Therefore, the positional accuracy of the developing cartridge 16 relative to the drum cartridge 15 may be enhanced. Thus, during an image forming operation, the application of the urging force of the spring member 42 may reduce or prevent the developing cartridge 16 from being displaced relative to the drum cartridge 15.

The handle unit 41 contacts the developing cartridge 16 being joined to the drum cartridge 15 in the direction intersecting the detaching direction D, and the restraining member 96 contacts the developing cartridge 16 from the opposite side to the handle unit 41 with respect to the developing cartridge 16. That is, the developing cartridge 16 being joined to the drum cartridge 15 is interposed between the handle unit 41 and the restraining member 96 in the direction intersecting the detaching direction D.

Therefore, while the developing cartridge 16 being joined to the drum cartridge 15 is restricted from moving in the direction intersecting the detaching direction D, the developing cartridge 16 may be allowed to move in the detaching direction D.

With this configuration, for example, even if vibration caused by rotation of the photosensitive drum 17 is transmitted to the developing cartridge 16 being joined to the drum cartridge 15, the developing cartridge 16 may absorb the vibration by moving in the detaching direction D. Accordingly, this configuration may reduce or prevent an occurrence of positional deviation of the developing cartridge 16 relative to the photosensitive drum 17 in the direction intersecting the detaching direction D.

(10) As depicted in FIG. 1, the restraining member 96 is in contact with the developing cartridge 16 being joined to the drum cartridge 15 in a state where the front cover 7 is located at the closing position. Therefore, in a state where the developing cartridge 16 is attached to the printer body 2, this configuration may surely enhance the positional accuracy of the developing cartridge 16 relative to the drum cartridge 15.

As depicted in FIG. 2, in a state where the front cover 7 is located at the exposing position, the restraining member 96 is located outside the printer body 2. Therefore, this configuration may reduce or prevent the restraining member 96 from obstructing the attachment or detachment of the developing cartridge 16 to or from the drum cartridge 15.

(11) As depicted in FIG. 2, in a state where the developing cartridge 16 is free from the contact with the restraining member 96, the developing cartridge 16 is located further downstream in the spring direction X than the developing cartridge 16 in which the restraining member 96 is in contact with the developing cartridge 16.

Therefore, the user may access the developing cartridge 16 further readily, thereby detaching the developing cartridge 16 from the drum cartridge 15 further smoothly.

(12) As depicted in FIG. 4B, the upper surface 66A of the grip portion 66 guides the attachment of the developing cartridge 16 to the drum cartridge 15. Accordingly, the developing cartridge 16 may be joined to the drum cartridge 15 further smoothly.

8. Second Illustrative Embodiment

Figure 6:
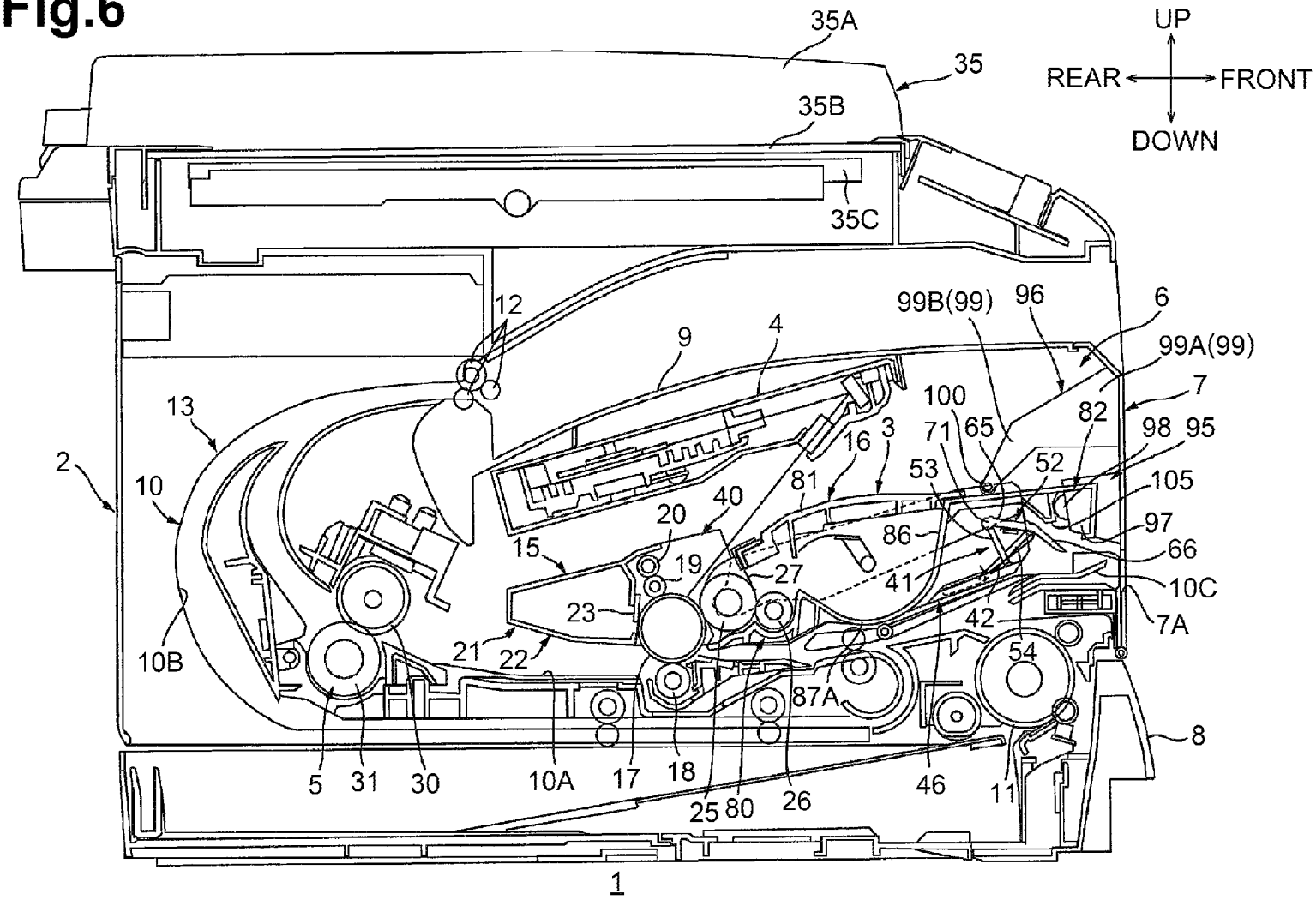
FIG. 6 is a central sectional view depicting a printer in a second illustrative embodiment according to one or more aspects of the disclosure, wherein a front cover is located at a closing position.
Figure 7:
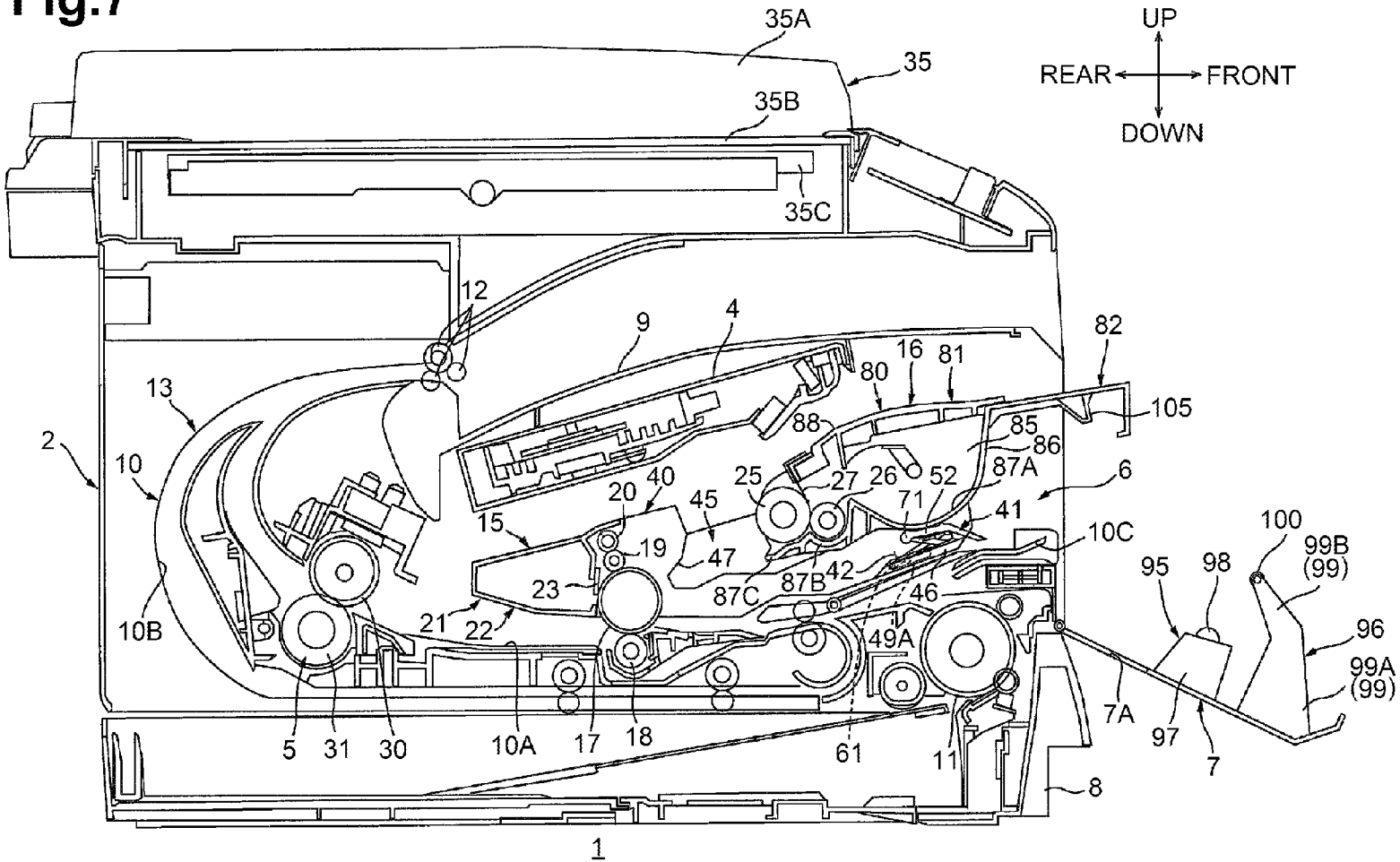
FIG. 7 is a central cross-sectional view depicting the printer of FIG. 6 in the second illustrative embodiment according to one or more aspects of the disclosure, wherein a developing cartridge is in progress of being attached from a drum cartridge.
Figure 8:
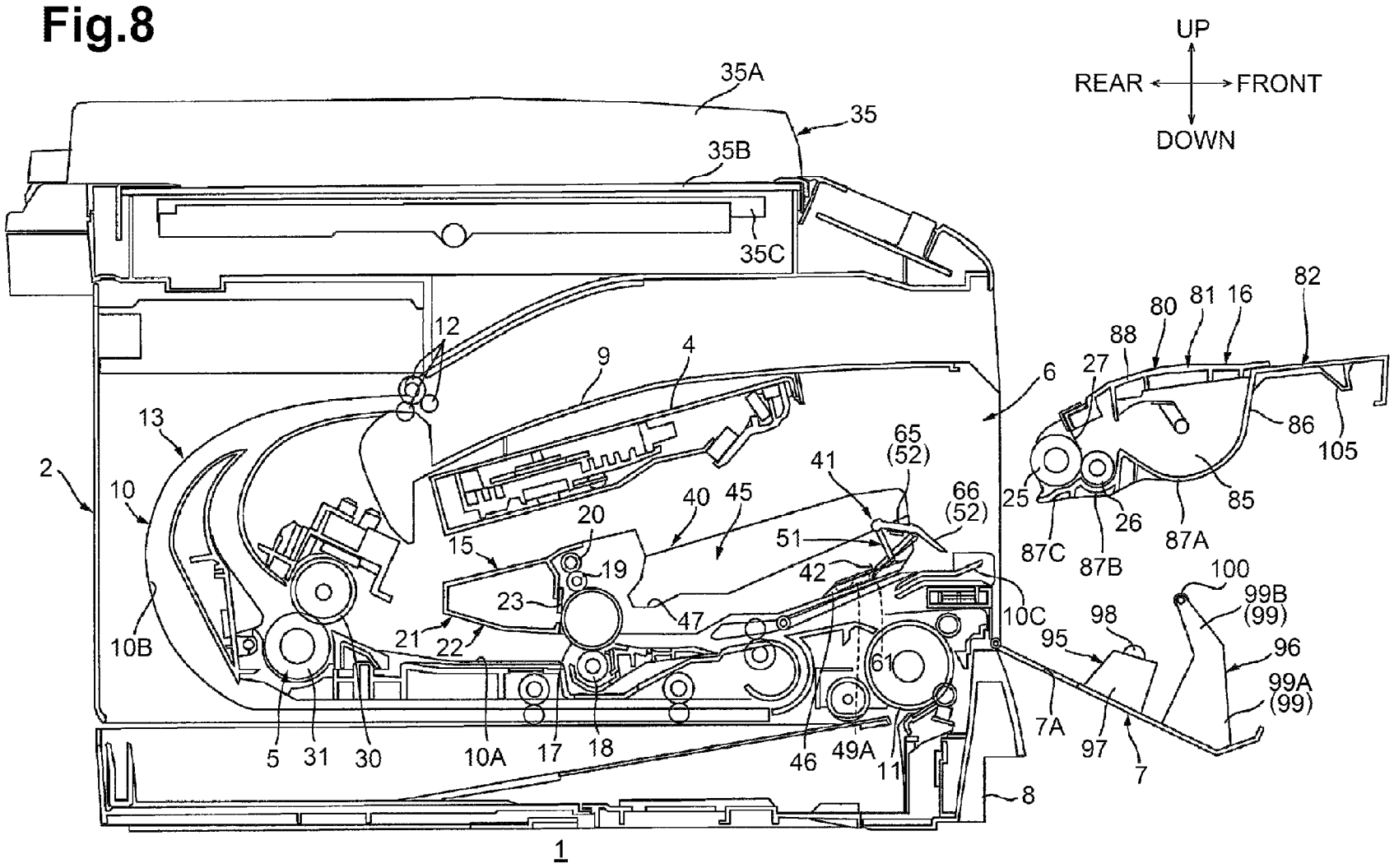
FIG. 8 is a central cross-sectional view depicting the printer of FIG. 7 in the second illustrative embodiment according to one or more aspects of the disclosure, wherein the developing cartridge is completely detached from the drum cartridge.

Referring to FIGS. 6, 7, and 8, an image forming apparatus of a second illustrative embodiment will be described. An explanation will be given mainly for the parts different from the first illustrative embodiment, and an explanation will be omitted for the common parts by assigning the same reference numerals thereto.

In the first illustrative embodiment, as depicted in FIG. 1, in a state where the developing cartridge 16 is located at the attached position, the handle unit 41 is located at the retracted position. Nevertheless, in the second illustrative embodiment, for example, in a state where a developing cartridge 16 is located at its attached position, a handle unit 41 is located at a protruding position.

In the second illustrative embodiment, the developing cartridge 16 includes a contact portion 105 instead of the contact unit 83 of the first illustrative embodiment.

The contact portion 105 is disposed at a lower surface of an extended portion 82A of a developing-cartridge handle 82. The contact portion 105 may have a substantially rectangular shape in side view. The contact portion 105 protrudes downward from a substantially middle portion of the lower surface of the extended portion 82A in the front-rear direction.

In a state where the developing cartridge 16 is located at the attached position, a pressing portion 98 of a pressing unit 95 is in contact with the contact portion 105 from the front and the contact portion 105 is located diagonally above to the front of the handle unit 41 located at the protruding position. Thus, the handle unit 41 is retained at the protruding position in the state where the developing cartridge 16 is located at the attached position.

For detaching the developing cartridge 16 from a printer body 2, as described above, the user moves a front cover 7 to an exposing position and then pulls the developing cartridge 16 obliquely upward toward the front by holding the developing-cartridge handle 82.

As the developing cartridge 16 moves obliquely upward toward the front, as depicted in FIGS. 6 and 7, a curved portion 87A of a cartridge frame 80 comes into contact with a circular column portion 71 of the handle unit 41 from upper rear. Thus, the circular column portion 71 is pressed obliquely downward toward the front by the curved portion 87A and the handle unit 41 moves from the protruding position toward the retracted position.

As the developing cartridge 16 is pulled further frontward, as depicted in FIG. 7, the curved portion 87A, an arc portion 87B, and a lip portion 87C of a bottom wall 87 slide over an upper surface of a contact portion 65 of a handle body 52 one after another.

Then, the developing cartridge 16 is detached from the printer body 2 through the opening 6 while passing over the handle unit 41.

Thus, the contact portion 65 becomes free from the contact with the bottom wall 87, and the handle unit 41 returns to the protruding position by an urging force of a spring member 42.

That is, in the second illustrative embodiment, as depicted in FIGS. 6, 7, and 8, during detachment of the developing cartridge 16 from the printer body 2, the handle unit 41 moves from the protruding position to the retracted position temporarily and returns to the protruding position.

In the second illustrative embodiment, in the developing cartridge 16 is separated from the drum cartridge 15 (more specifically, in a state where the developing cartridge 16 is detached from the printer body 2), the handle unit 41 is located at the protruding position.

Accordingly, the same effect may be obtained in the second illustrative embodiment as the effect obtained in the first illustrative embodiment.

9. Third to Sixth Illustrative Embodiments

Referring to FIGS. 9A, 9B, 10A, and 10B, third to sixth illustrative embodiments will be described. An explanation will be given mainly for the parts different from the first illustrative embodiment, and an explanation will be omitted for the common parts by assigning the same reference numerals thereto.

(1) Third Illustrative Embodiment

In the first illustrative embodiment, as depicted in FIG. 4B, the spring member 42 may be a leaf spring. Nevertheless, the configuration of the spring member 42 is not limited as long as the spring member 42 urges the handle body 52 upward.

Figure 9A:
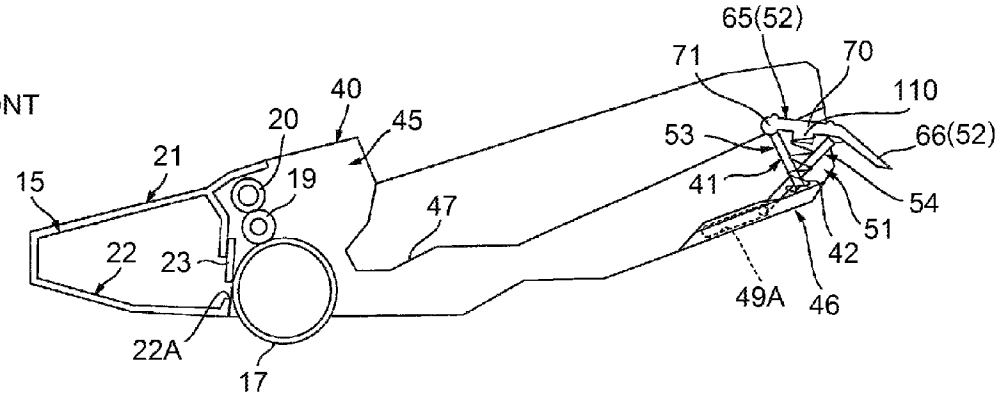
FIG. 9A is a central cross-sectional view depicting a drum cartridge in a third illustrative embodiment according to one or more aspects of the disclosure.

For example, in the third illustrative embodiment, as depicted in FIG. 9A a spring member 42 may have an air-core coil shape and extends obliquely upward toward the front.

In the third illustrative embodiment, a contact portion 65 includes a protrusion 110. The protrusion 110 is disposed at a lower surface of a plate-shaped portion 70 of the contact portion 65. The protrusion 110 may have a substantially circular column shape and protrudes obliquely downward toward the rear from the plate-shaped portion 70. The protrusion 110 has an outside diameter that is approximately equal to an inside diameter of the spring member 42.

An upper end portion of the spring member 42 is engaged with the protrusion 110 by insertion thereto while a lower rear end portion of the spring member 42 is in contact with an upper surface of a handle supporting wall 46. Therefore, the spring member 42 urges the plate-shaped portion 70 of the contact portion 65 obliquely upward toward the front at all times and also urges a handle unit 41 toward the protruding position at all times.

Accordingly, the same effect may be obtained in the third illustrative embodiment as the effect obtained in the first illustrative embodiment.

(2) Fourth Illustrative Embodiment

Figure 9B:
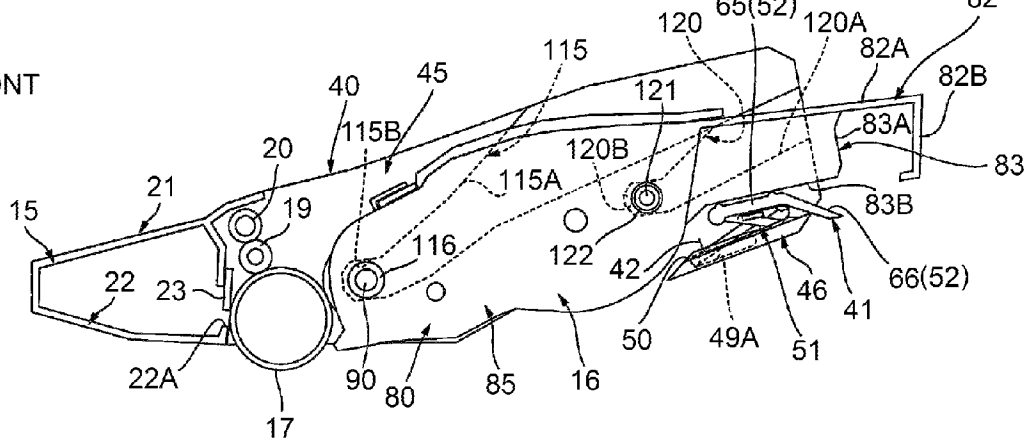
FIG. 9B is a central cross-sectional view depicting a drum cartridge and a developing cartridge in a fourth illustrative embodiment according to one or more aspects of the disclosure.

In the first illustrative embodiment, as depicted in FIG. 1, the restraining member 96 of the printer body 2 retains the developing cartridge 16 at the attached position by contacting the developing-cartridge handle 82 of the developing cartridge 16. In the fourth illustrative embodiment, as depicted in FIG. 9B, a developing cartridge 16 and a drum cartridge 15 are engaged with each other to retain the developing cartridge 16 at its attached position. That is, in the fourth illustrative embodiment, a printer body 2 might not necessarily include a restraining member 96.

As depicted in FIG. 9B, in the fourth illustrative embodiment, a right sidewall 45 of a drum cartridge 15 has a first engagement groove 115 and a second engagement groove 120 instead of the receiving groove 47 (refer to FIG. 4B).

The first engagement groove 115 and the second engagement groove 120 are defined in an inner surface of the right sidewall 45 in the right-left direction. The first engagement groove 115 and the second engagement groove 120 are recessed outward (e.g., rightward) relative to the inner surface of the right sidewall 45 in the right-left direction. A left sidewall 45 (not depicted) has the same or similar configuration to the right sidewall 45. In the explanation below, the right sidewall 45 will be described in detail.

The first engagement groove 115 includes a first guide portion 115A and a first deepest portion 115B.

The first guide portion 115A extends obliquely downward toward the rear from an upper end of a frontward portion of the right sidewall 45. The first guide portion 115A is tapered downward toward the rear. The first deepest portion 115B is angled relative to the first guide portion 115A and contiguously extends rearward from a lower rear end of the first guide portion 115A. The first deepest portion 115B has a substantially U shape in side view and opens toward the front.

The second engagement groove 120 is defined below a frontward portion of the first guide portion 115A. The second engagement groove 120 includes a second guide portion 120A and a second deepest portion 120B.

The second guide portion 120A extends obliquely downward toward the rear from a front end of a substantially middle portion in the up-down direction of the right sidewall 45. The second guide portion 120A is tapered downward toward the rear.

The second deepest portion 120B is angled relative to the second guide portion 120A and contiguously extends rearward from a lower rear end of the second guide portion 120A. The second deepest portion 120B has a substantially U shape in side view and opens toward the front.

A developing roller 25 further includes right and left collars 116 corresponding to the respective first engagement grooves 115.

The right and left collars 116 correspond to right and left end portions, respectively, of a roller shaft 90. The collars 116 have a substantially circular cylindrical shape extending in the right-left direction. As depicted in FIG. 9B, the right collar 116 has an inside diameter that is substantially the same as an outside diameter of the roller shaft 90, and has an outside diameter that is substantially the same as a height of the first deepest portion 115B of the right first engagement groove 115. The right collar 116 is engaged with the right end portion of the roller shaft 90 so as to be rotatable relative to the roller shaft 90 while the right collar 116 is disposed closer to the exterior of the printer than the right sidewall 85 in the right-left direction. The left collar 116 has the same or similar configuration to the right collar 116.

The right and left sidewalls 85 of the developing cartridge 16 each include a protrusion 121 corresponding to one of the second engagement grooves 120.

As depicted in FIG. 9B, the right protrusion 121 is disposed at a front end portion of an outer surface of the right sidewall 85 in the right-left direction. The protrusion 121 has a substantially circular column shape extending in the right-left direction. The protrusion 121 protrudes rightward from the outer surface of the right sidewall 85 in the right-left direction. The left protrusion 121 has the same or similar configuration to the right protrusion 121.

The right collar 122 is engaged with the right protrusion 121 so as to be rotatable relative to the right protrusion 121. The right collar 122 has a substantially circular cylindrical shape extending in the right-left direction. The right collar 122 has an inside diameter that is substantially the same as an outside diameter of the right protrusion 121, and as an outside diameter that is substantially the same as a width of the second deepest portion 120B of the right second engagement groove 120. The left collar 122 has the same or similar configuration to the right collar 122.

In a state where the developing cartridge 16 is joined to the drum cartridge 15, the right collar 116 of the developing roller 25 is located at the first deepest portion 115B of the right first engagement groove 115 and the right collar 122 of the right sidewall 85 is located at the second deepest portion 120B of the second engagement groove 120.

Therefore, an upper end portion of the right collar 116 of the developing roller 25 is in contact with an upper end of the first deepest portion 115B while an upper end portion of the right collar 122 of the sidewall 85 is in contact with an upper end of the second deepest portion 120B.

Accordingly, this configuration restricts an upward movement of the developing cartridge 16 relative to the drum cartridge 15.

A handle unit 41 is pressed by a contact unit 83 of the developing cartridge 16 located at the attached position to be retained at the retracted position against an urging force of a spring member 42.

According to the fourth illustrative embodiment, although the printer body 2 might not include a restraining member 96, the developing cartridge 16 may be surely retained at the attached position. Therefore, a parts count may be reduced. The same effect may be obtained in the fourth illustrative embodiment as the effect obtained in the first illustrative embodiment.

(3) Fifth Illustrative Embodiment

In the first illustrative embodiment, as depicted in FIG. 4B, the handle unit 41 constitutes a pantograph mechanism. Nevertheless, the configuration of the handle unit 41 is not limited to the particular example.

Figure 10A:
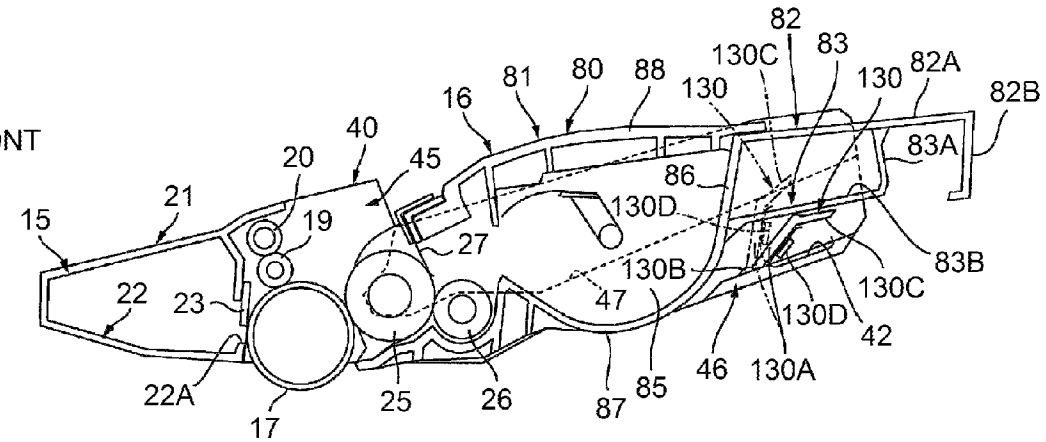
FIG. 10A is a central cross-sectional view depicting a drum cartridge and a developing cartridge in a fifth illustrative embodiment according to one or more aspects of the disclosure.

For example, in the fifth illustrative embodiment, as depicted in FIG. 10A, a drum cartridge 15 includes a handle unit 130 (as another example of the handle) instead of the handle unit 41.

The handle unit 130 includes a connecting portion 130A, a shaft portion 130B, a grip portion 130C (as an example of the handle body), and a spring retaining portion 130D.

The handle unit 130 is pivotable between a retracted position at which the handle unit 130 is located near a handle supporting wall 46 in an tilted position and a protruding position at which the handle unit 130 is located distant from the handle supporting wall 46 in a substantially standing position. Hereinafter, the handle unit 130 will be described with reference to a state where the handle unit 130 is located at the retracted position.

The connecting portion 130A has a substantially plate-like shape and extends obliquely upward toward the front from a handle supporting wall 46.

The shaft portion 130B is disposed at a lower end of the handle unit 130. The shaft portion 13B has a substantially circular column shape extending in the right-left direction. The shaft portion 130B is fixed to the lower end portion of the connecting portion 130A so as not to be rotatable relative to the connecting portion 130A.

The grip portion 130C is disposed at an upper end of the handle unit 130. The grip portion 130C has a substantially plate shape extending in the front-rear direction. The grip portion 130C contiguously extends frontward from an upper end of the connecting portion 130A.

The spring retaining portion 130D is disposed diagonally below the connecting portion 130A while being spaced from the connecting portion 130A. The spring retaining portion 130D has a substantially plate-like shape and extends obliquely upward toward the front. At least one of right and left end portions of the spring retaining portion 130D is connected with the connecting portion 130A.

The handle unit 130 is supported by a cartridge frame 40 while the shaft portion 130B is rotatably fixed to the handle supporting wall 46. With this configuration, the handle unit 130 is pivotable on an axis of the shaft portion 130B.

A spring member 42 has a substantially V-letter shape in side view and opens obliquely upward toward the front. The spring member 42 is disposed between the connecting portion 130A and the handle supporting wall 46 while an upper portion of the spring member 42 is retained between the connecting portion 130A and the spring retaining portion 130D.

With this configuration, the spring member 42 urges the connecting portion 130A obliquely upward toward the rear at all times, thereby urging the handle unit 130 toward the protruding position at all times.

In a state where the developing cartridge 16 is located at the attached position, a contact portion 83B of a contact unit 83 is in contact with the grip portion 130C of the handle unit 130 from above. Thus, the handle unit 130 is retained at the retracted position against an urging force of the spring member 42 in the state where the developing cartridge 16 is located at the attached position.

In the fifth illustrative embodiment, as the developing cartridge 16 is separated from the drum cartridge 15, the contact portion 83B is disengaged from the grip portion 130C and the handle unit 130 pivots in the counterclockwise direction in left side view toward the protruding position from the retracted position by the urging force of the spring member 42.

Accordingly, the same effect may be obtained in the fifth illustrative embodiment as the effect obtained in the first illustrative embodiment.

(4) Sixth Illustrative Embodiment

Figure 10B:
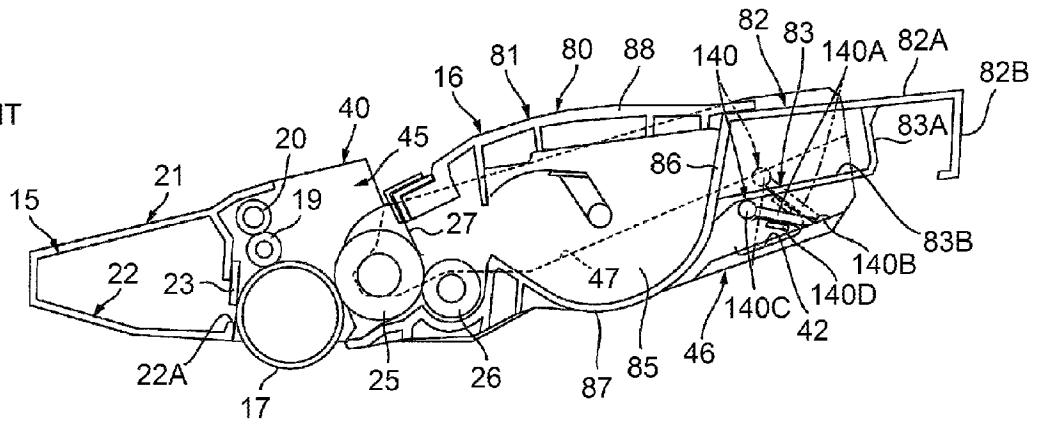
FIG. 10B is a central cross-sectional view depicting a drum cartridge and a developing cartridge in a sixth illustrative embodiment according to one or more aspects of the disclosure.

In the sixth illustrative embodiment, as depicted in FIG. 10B, a drum cartridge 15 includes a handle unit 140 (as another example of the handle) instead of the handle unit 41.

The handle unit 140 includes a connecting portion 140A, a shaft portion 140B, a grip portion 140C (as another example of the handle body), and a spring retaining portion 140D.

The handle unit 140 is pivotable between a retracted position at which the handle unit 140 is located near a handle supporting wall 46 in a tilted position and a protruding position at which the handle unit 140 is located distant from the handle supporting wall 46 in a slight tilted position. Hereinafter, the handle unit 140 will be described with reference to a state where the handle unit 140 is located at the retracted position.

The connecting portion 140A has a substantially plate-like shape and extends obliquely upward toward the rear from the handle supporting wall 46.

The shaft portion 140B is disposed at a lower end of the handle unit 140. The shaft portion 140B has a substantially circular column shape extending in the right-left direction. The shaft portion 140B is fixed to the lower end of the connecting portion 140A so as not to be rotatable relative to the connecting portion 140A.

The grip portion 140C is disposed at an upper end of the handle unit 140. The grip portion 140C has a substantially circular column shape extending in the right-left direction. The grip portion 140C is fixed to an upper end of the connecting portion 140A so as not to be rotatable relative to the connecting portion 140A.

The spring retaining portion 140D is disposed diagonally below the connecting portion while being spaced from the connecting portion 140A. The spring retaining portion 140D has a substantially plate-like shape and extends obliquely upward toward the rear. At least one of right and left end portions of the spring retaining portion 140D is connected with the connecting portion 140A.

The handle unit 140 is supported by a cartridge frame 40 while the shaft portion 140B is rotatably fixed to the handle supporting wall 46. With this configuration, the handle unit 140 is pivotable on an axis of the connecting portion 140B.

The spring member 42 has a substantially V-letter shape in side view and opens toward the rear. The spring member 42 is disposed between the connecting portion 140A and the handle supporting wall 46 while an upper portion of the spring member 42 is retained between the connecting portion 140A and the spring retaining portion 140D.

With this configuration, the spring member 42 urges the connecting portion 140A obliquely upward toward the front at all times, thereby urging the handle unit 140 toward the protruding position at all times.

In a state where the developing cartridge 16 is located at the attached position, the contact portion 83B of the contact unit 83 is in contact with the grip portion 140C from above. Thus, the handle unit 140 is retained at the retracted position against an urging force of the spring member 42 in the state where the developing cartridge 16 is located at the attached position.

In the sixth illustrative embodiment, as the developing cartridge 16 is separated from the drum cartridge 15, the contact portion 83B is disengaged from the grip portion 140C and the handle unit 140 pivots in the counterclockwise direction in left side view toward the protruding position from the retracted position by an urging force of the spring member 42.

Accordingly, the same effect may be obtained in the sixth illustrative embodiment as the effect obtained in the first illustrative embodiment.

While the disclosure has been described in detail with reference to the specific embodiments thereof, these are merely examples, and various changes, arrangements and modifications may be applied therein without departing from the spirit and scope of the disclosure.

10. Variations

In the first to sixth illustrative embodiments, the urging member may be the spring member 42 that may be one of the leaf spring and the coil spring. Nevertheless, in other embodiments, the urging member may be, for example, a rubber member or a sponge member.

Two or more of the examples illustrated in the first to sixth illustrative embodiments may be combined in an appropriate manner.

What is claimed is:

1. An image forming apparatus comprising:

a printer body having an opening on a side surface thereof and including an opening/closing member configured to move between an exposing position at which the opening/closing member exposes the opening and a closing position at which the opening/closing member closes the opening;

a drum cartridge detachably attachable to the printer body through the opening and including a photosensitive drum; and a developing cartridge detachably attachable to the drum cartridge and configured to store a developing agent therein, the developing cartridge being located downstream of the photosensitive drum in a predetermined direction in which the developing cartridge is detached from the drum cartridge, the opening/closing member being configured to press the developing cartridge downwardly in an up-down direction intersecting the predetermined direction;

wherein the drum cartridge includes:

a handle configured to move between a protruding position at which the handle protrudes toward an attaching/detaching path for attaching and detaching the developing cartridge to and from the drum cartridge and a retracted position at which the handle is located farther from the attaching/detaching path than the handle that is located at the protruding position; and an urging member urging the handle toward the protruding position, and wherein the handle is configured to protrude toward the predetermined direction by an urging force of the urging member when the developing cartridge is detached from the drum cartridge.

2. The image forming apparatus according to claim 1, wherein the handle is configured to move between the protruding position and the retracted position in the up-down direction intersecting the predetermined direction.

3. The image forming apparatus according to claim 1, wherein when the developing cartridge is attached to the drum cartridge, the developing cartridge contacts the handle and the handle is located at the retracted position against the urging force of the urging member.

4. The image forming apparatus according to claim 3, wherein the developing cartridge further includes a contact portion configured to contact with the handle when the developing cartridge is attached to the drum cartridge, and wherein the contact portion and the handle contact with each other in the up-down direction intersecting the predetermined direction.

5. The image forming apparatus according to claim 1, wherein the handle further includes a shaft portion rotatably fixed to the drum cartridge, wherein the handle is configured to pivot between the protruding position and the retracted position on the shaft portion, and wherein the handle pivots downstream in the predetermined direction as the handle moves from the retracted position toward the protruding position.

6. The image forming apparatus according to claim 5, wherein the handle further includes:

a handle body including a grip portion; and a connecting portion having one end portion rotatably fixed to the handle body and the other end portion including the shaft portion.

7. The image forming apparatus according to claim 6, wherein the handle further includes a supporting portion configured to support the handle body.

8. The image forming apparatus according to claim 7, wherein the supporting portion is disposed intersecting the connecting portion when viewed in an axial direction of the shaft portion, and wherein the supporting portion has one end portion that is rotatably fixed to the handle body and the other end portion that is pivotably and slidably supported by the drum cartridge.

9. The image forming apparatus according to claim 1, wherein the printer body includes a pressing member configured to contact and press the developing cartridge being attached to the drum cartridge from a side opposite to a side where the handle is disposed with respect to the developing cartridge.

10. The image forming apparatus according to claim 9, wherein the opening/closing member includes the pressing member, and wherein the pressing member is configured to contact with the developing cartridge when the opening/closing member is located at the closing position.

11. The image forming apparatus according to claim 9, wherein when the developing cartridge is not in contact with the pressing member, the developing cartridge is, by being pressed by the handle, located further downstream in a direction, in which the handle protrudes, than the developing cartridge that is in contact with the pressing member.

12. The image forming apparatus according to claim 1, wherein the handle has a guide surface configured to guide attachment of the developing cartridge to the drum cartridge.

13. The image forming apparatus according to claim 1, wherein the urging member is a leaf spring.

14. The image forming apparatus according to claim 1, wherein the urging member is a coil spring.

15. The image forming apparatus according to claim 1, wherein the predetermined direction is perpendicular to an axial direction of the photosensitive drum.

16. An image forming apparatus comprising:

a printer body;

a drum cartridge detachably attachable to the printer body and including a photosensitive drum;

a developing cartridge detachably attachable to the drum cartridge in a predetermined direction and configured to store a developing agent therein;

a first pressing mechanism configured to press the developing cartridge downwardly in an up-down direction intersecting the predetermined direction; and a second pressing mechanism configured to press the developing cartridge upwardly in the up-down direction, wherein in response to release of pressing of the first pressing mechanism, the second pressing mechanism is configured to press the developing cartridge upwardly in the up-down direction with respect to the drum cartridge.

17. The image forming apparatus according to claim 16, wherein the second pressing mechanism includes a handle for detaching the drum cartridge from the printer body.

18. The image forming apparatus according to claim 16, wherein the printer body further has an opening and an opening/closing member that is configured to move between an exposing position at which the opening/closing member exposes the opening and a closing position at which the opening/closing member closes the opening, and wherein the first pressing mechanism is positioned in the opening/closing member.

19. The image forming apparatus according to claim 16, wherein the second pressing mechanism is positioned in the drum cartridge.

20. An image forming apparatus comprising:

a printer body;

a drum cartridge detachably attachable to the printer body and including a photosensitive drum;

a developing cartridge detachably attachable to the drum cartridge in a predetermined direction and configured to store a developing agent therein;

a pressing mechanism configured to press the developing cartridge upwardly in an up-down direction intersecting the predetermined direction, wherein in response to detaching the developing cartridge from the drum cartridge, the pressing mechanism is configured to protrude in the predetermined direction.

* * * * *